US009744738B2

(12) United States Patent
Pugh et al.

(10) Patent No.: US 9,744,738 B2
(45) Date of Patent: Aug. 29, 2017

(54) EMBOSSED SHEET AND METHOD OF MAKING AND USING SAME

(75) Inventors: Jeffrey D. Pugh, Minnetrista, MN (US); Merrill Jon Hansen, New Hope, MN (US)

(73) Assignee: Smart Packaging, LLC, Plymouth, MN (US)

( * ) Notice: Subject to any disclaimer, the term of this patent is extended or adjusted under 35 U.S.C. 154(b) by 166 days.

(21) Appl. No.: 13/273,029

(22) Filed: Oct. 13, 2011

(65) Prior Publication Data

US 2013/0095216 A1 Apr. 18, 2013

(51) Int. Cl.

| | |
|---|---|
| ***B65D 85/76*** | (2006.01) |
| ***B30B 11/18*** | (2006.01) |
| ***B30B 15/02*** | (2006.01) |

(52) U.S. Cl.

CPC ..... *B30B 11/18* (2013.01); *B30B 15/022* (2013.01); *B65D 2585/366* (2013.01); *Y10T 428/13* (2015.01); *Y10T 428/24479* (2015.01); *Y10T 428/24612* (2015.01)

(58) Field of Classification Search

CPC B65D 81/26; B65D 81/261; B65D 2585/366; A47J 36/027; A47J 36/04

USPC ..... 426/128

See application file for complete search history.

(56) References Cited

U.S. PATENT DOCUMENTS

| | | | | |
|---|---|---|---|---|
| 3,861,576 A | | 1/1975 | Tolaas et al. | |
| 4,373,636 A | * | 2/1983 | Hoffman | 206/551 |
| 4,391,833 A | | 7/1983 | Self et al. | |
| 4,441,626 A | | 4/1984 | Hall | |
| 4,717,069 A | * | 1/1988 | Pizzolato | B65D 5/42 206/545 |
| 4,757,940 A | | 7/1988 | Quick et al. | |
| 4,785,968 A | | 11/1988 | Logan et al. | |
| 4,935,282 A | | 6/1990 | Pawlowski et al. | |
| 5,000,374 A | | 3/1991 | Deiger | |
| 5,128,522 A | | 7/1992 | Marx et al. | |
| 5,402,930 A | | 4/1995 | Storms et al. | |
| 5,411,204 A | | 5/1995 | DeMay | |

(Continued)

FOREIGN PATENT DOCUMENTS

| | | |
|---|---|---|
| DE | 29924321 | 9/2002 |
| DE | 102007023015 | 5/2007 |

(Continued)

OTHER PUBLICATIONS

SOLUT! Forming Sustainable Solutions; "SOLUT! Thermoformed Food Packaging"; Website; 2010; p. 1.

(Continued)

*Primary Examiner* — Jeffrey Allen

(74) *Attorney, Agent, or Firm* — Thomas J. Oppold; Larkin Hoffman Daly & Lindgren, Ltd.

(57) ABSTRACT

A embossed sheet embossed with projections creating an intermittent support surface for food. The embossed sheet may be inserted into a food package after cooking the food on which the cooked food is to be supported. Alternatively, the embossed sheet may be placed onto or into a pan or directly onto an oven rack to support the food while cooking and/or after cooking. Alternatively, the embossed sheet may be formed into a food package. The embossed sheet may be prepared using a one-pass or two pass process using a platen press or a roll-to-roll press or a multi-stage one pass machine.

16 Claims, 29 Drawing Sheets

(56) References Cited

U.S. PATENT DOCUMENTS

| | | | | |
|---|---|---|---|---|
| 5,414,248 | A | 5/1995 | Phillips | |
| 5,423,477 | A | 6/1995 | Valdman et al. | |
| 5,484,984 | A | 1/1996 | Gics | |
| 5,565,228 | A * | 10/1996 | Gics | 426/107 |
| 5,615,796 | A | 4/1997 | Rench | |
| 5,628,426 | A | 5/1997 | Doyle et al. | |
| 5,895,698 | A * | 4/1999 | Cacciatore et al. | 206/525 |
| 6,019,511 | A | 2/2000 | Thomas et al. | |
| D429,446 | S | 8/2000 | Toussant et al. | |
| 6,097,017 | A | 8/2000 | Pickford | |
| 6,179,203 | B1 | 1/2001 | Toussant et al. | |
| 6,491,214 | B2 | 12/2002 | Plummer et al. | |
| 6,695,202 | B2 * | 2/2004 | Miess | 229/115 |
| 6,752,311 | B2 | 6/2004 | Tulkoff | |
| 7,196,299 | B2 | 3/2007 | Hasse et al. | |
| 7,210,613 | B2 | 5/2007 | Lehrer | |
| 7,319,213 | B2 | 1/2008 | Tsontzidis et al. | |
| 7,342,207 | B2 | 3/2008 | Hasse et al. | |
| 7,387,231 | B2 | 6/2008 | Yandian et al. | |
| 7,678,036 | B1 | 3/2010 | Malitas et al. | |
| 7,735,649 | B2 * | 6/2010 | Kim-Gifford et al. | 206/485 |
| D627,635 | S | 11/2010 | Krupa | |
| 8,026,464 | B2 * | 9/2011 | Romeo et al. | 219/730 |
| 2002/0040862 | A1 * | 4/2002 | Lizzio | B65D 77/0433 206/765 |
| 2004/0115401 | A1 | 6/2004 | Talja et al. | |
| 2006/0060579 | A1 * | 3/2006 | Guarrascio | B65D 25/04 220/4.21 |
| 2006/0131369 | A1 * | 6/2006 | Oddo | 229/104 |
| 2006/0289516 | A1 * | 12/2006 | Hasse et al. | 219/730 |
| 2008/0023469 | A1 * | 1/2008 | Fitzwater | 219/730 |
| 2008/0073416 | A1 * | 3/2008 | Walsh | 229/103.3 |
| 2008/0295985 | A1 | 12/2008 | Moncla et al. | |
| 2009/0206074 | A1 * | 8/2009 | Schneider | H05B 6/6494 219/730 |
| 2010/0001051 | A1 * | 1/2010 | Castiglioni et al. | 229/103 |
| 2010/0072197 | A1 * | 3/2010 | Neff et al. | 219/730 |
| 2010/0108750 | A1 | 5/2010 | Coleman, Jr. | |
| 2014/0110299 | A1 * | 4/2014 | Sporre Thorburn | B65D 83/08 206/451 |

FOREIGN PATENT DOCUMENTS

| | | | |
|---|---|---|---|
| EP | 565838 | A1 * | 10/1993 |
| EP | 0989067 | | 3/2000 |
| EP | 1193184 | | 4/2002 |
| EP | 1298073 | | 4/2003 |
| JP | 5-270541 | | 8/2013 |
| WO | WO9319989 | | 10/1993 |
| WO | WO 9520535 | A1 * | 8/1995 |

OTHER PUBLICATIONS

SOLUT! Forming Sustainable Solutions; "SOLUT! Take and Bake Pizza Trays"; Website; 2010; p. 1.

Boelter Industries, Inc. Custom Folding Carton & Paperboard Products Since 1969; "Paperboard"; Website; p. 1.

* cited by examiner

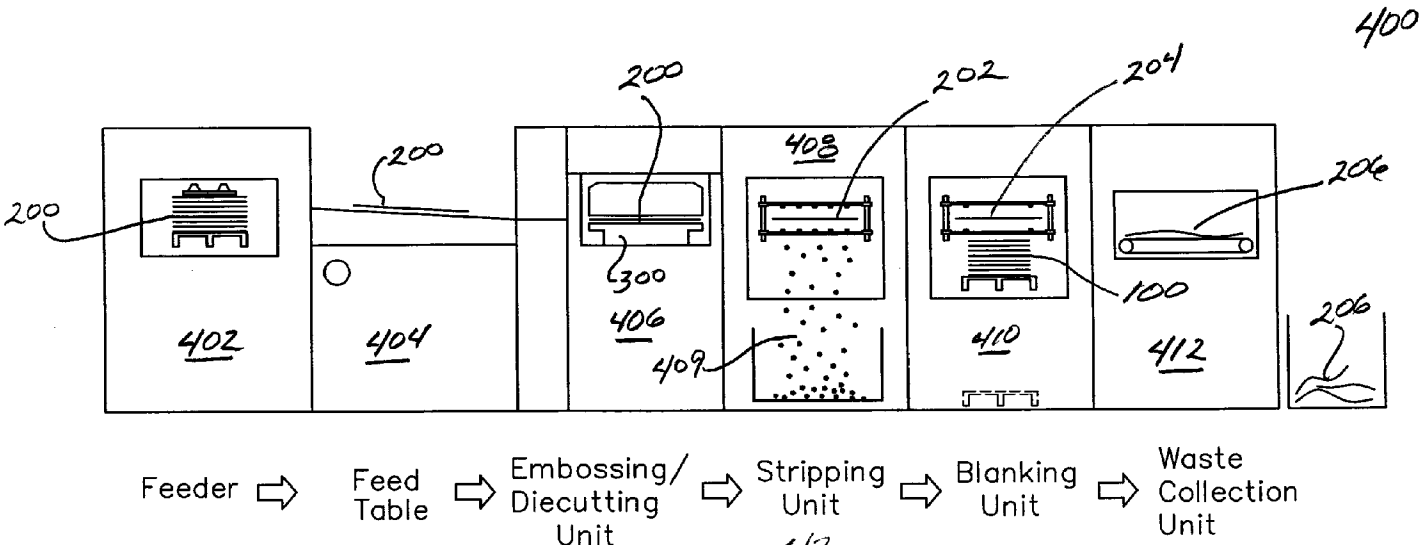
FIG. 4/3
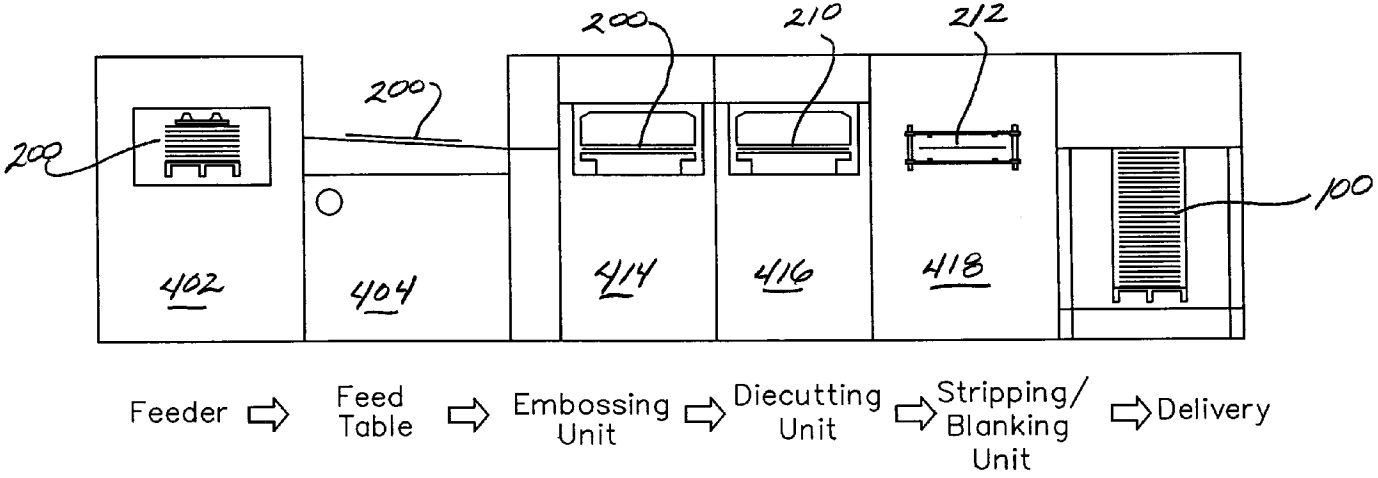
FIG. 4/4

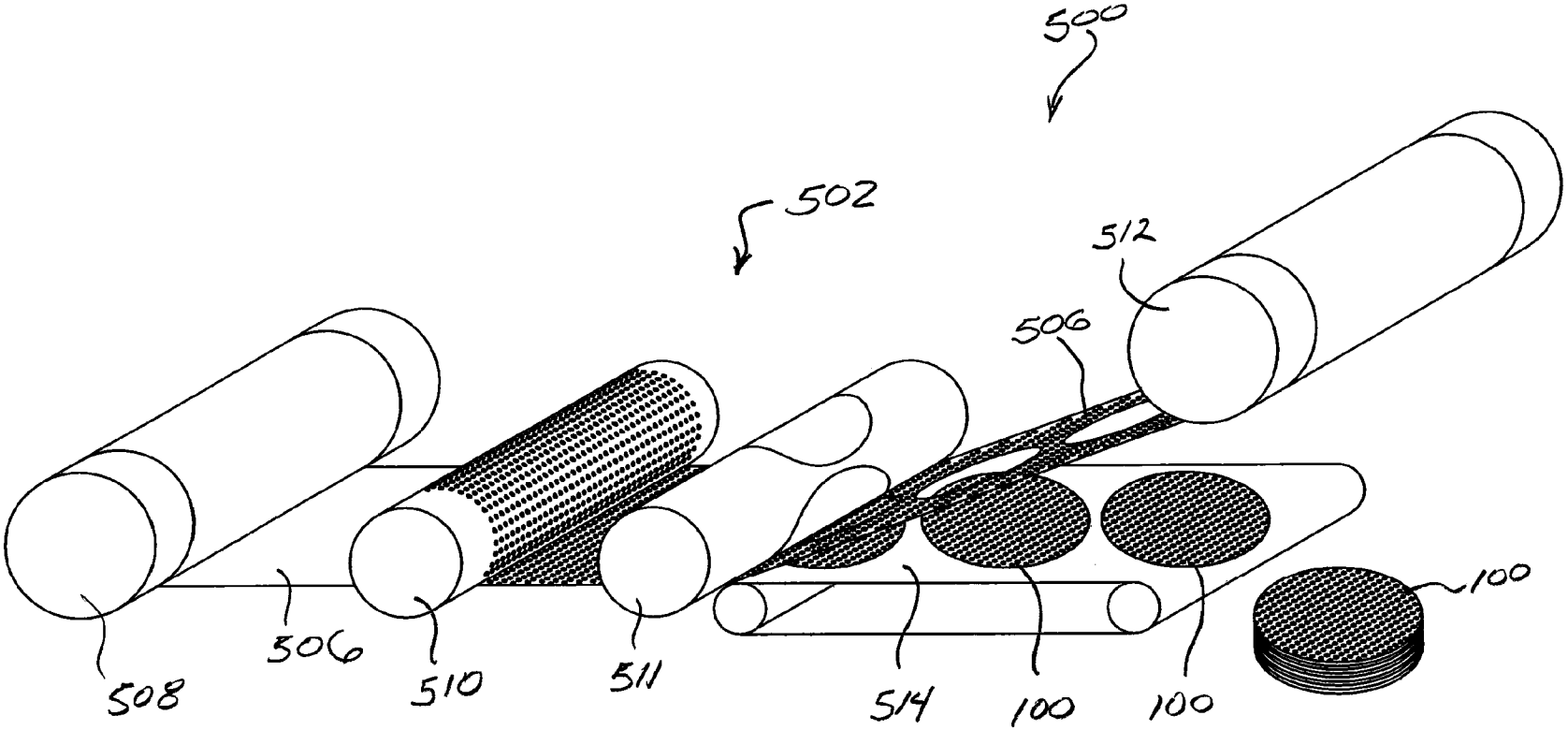
FIG. 4/5
(Continuous Roll-to-Roll)

(Stop & Go Roll-to-Roll)

EMBOSSED SHEET AND METHOD OF MAKING AND USING SAME

BACKGROUND

Most if not all cardboard pizza boxes are made from recycled pulp material. While the use of recycled pulp material for pizza boxes may be less expensive and more environmentally friendly than the use of virgin pulp material, if the recycled pulp materials was made from salvaged printed paper, the chemicals found in some printing inks can remain in the recycled pulp material. If this recycled pulp material is then used for packaging food, such as pizza, then the food can be exposed to those chemicals. In an article published in Science Daily (Nov. 30, 2007) reprinted from Wiley-Blackwell (Nov. 30, 2007), *Chemicals From Recycled Cardboard May Contaminate Take-out Food, Researchers Say*, a study conducted in Italy of pizza boxes from sixteen different pizza "take-away" restaurants found that the pizza boxes made from recycled material contained unacceptable levels of diisobutyl phthalate (DIBP), a plasticizer used as an additive to printing inks. The article states: "With take-out pizzas, hot food is placed inside the [recycled] cardboard box, and so there is a high chance that the food will be exposed to any volatile chemicals in the [recycled] cardboard such as plasticers . . . . To avoid this contamination, the boxes should be made from unrecycled materials." Id.

In the United States, pursuant to federal regulations 21 C.F.R. §176.260, the use of recycled material for food packaging that comes from industrial waste or which is salvaged from used paper is permitted, provided that the industrial waste or salvaged paper excludes (i) that which contains poisonous or deleterious substances capable of being retained in the recovered pulp and migrating to food, or (ii) that which is from paper used for shipping or handling any such substances. However, although the Food and Drug Administration (FDA) has regulations for food grade packaging, there are no official FDA guidelines for testing recycled paper to establish whether the recycled paper has suitable purity for packaging of foods.

Accordingly, there is a need in the food packaging industry, which allows the continued use of recycled cardboard for food packaging but which avoids direct contact of the food with the recycled cardboard to minimize potential migration of deleterious substances from the recycled material to the food.

In addition to concerns over food contamination when using recycled material, it would be desirable, with hot food in particular, to keep the food raised above the bottom of the container to avoid the food becoming soggy from condensation within the container or from grease or other juices dripping from the food. For example, when a hot pizza is removed from an oven and placed in a cardboard box, the steam from the hot pizza will begin to condense and collect at the bottom of the box causing the pizza crust to become soggy.

As with takeout and delivered pizzas, frozen pizzas and take-and-bake pizzas are also typically placed on recycled cardboard which may be removed prior to cooking the pizza or the cardboard may be formed into an oven-ready tray intended to go directly into the oven. With oven-ready trays, the cooked pizza is typically cut and served directly from the tray. Likewise with the pizza's that are removed from the cardboard prior to cooking, the cooked pizza is often placed back on the cardboard after cooking for cutting and serving. Thus, the use of recycled cardboard for frozen and take-and-bake pizzas presents the same concerns as using recycled cardboard for fresh delivered pizzas and also presents the same issues with the pizza becoming soggy.

DESCRIPTION OF THE DRAWINGS

FIG. 43 is a schematic illustration of an embodiment of a one-pass, multi-stage machine for forming an embossed sheet.

FIG. 44 is a schematic illustration of another embodiment of a one-pass, multi-stage machine for forming an embossed sheet.

FIG. 45 is a schematic illustration of an embodiment of a continuous roll-to-roll process for forming an embossed sheet.

DESCRIPTION

Figure 1:
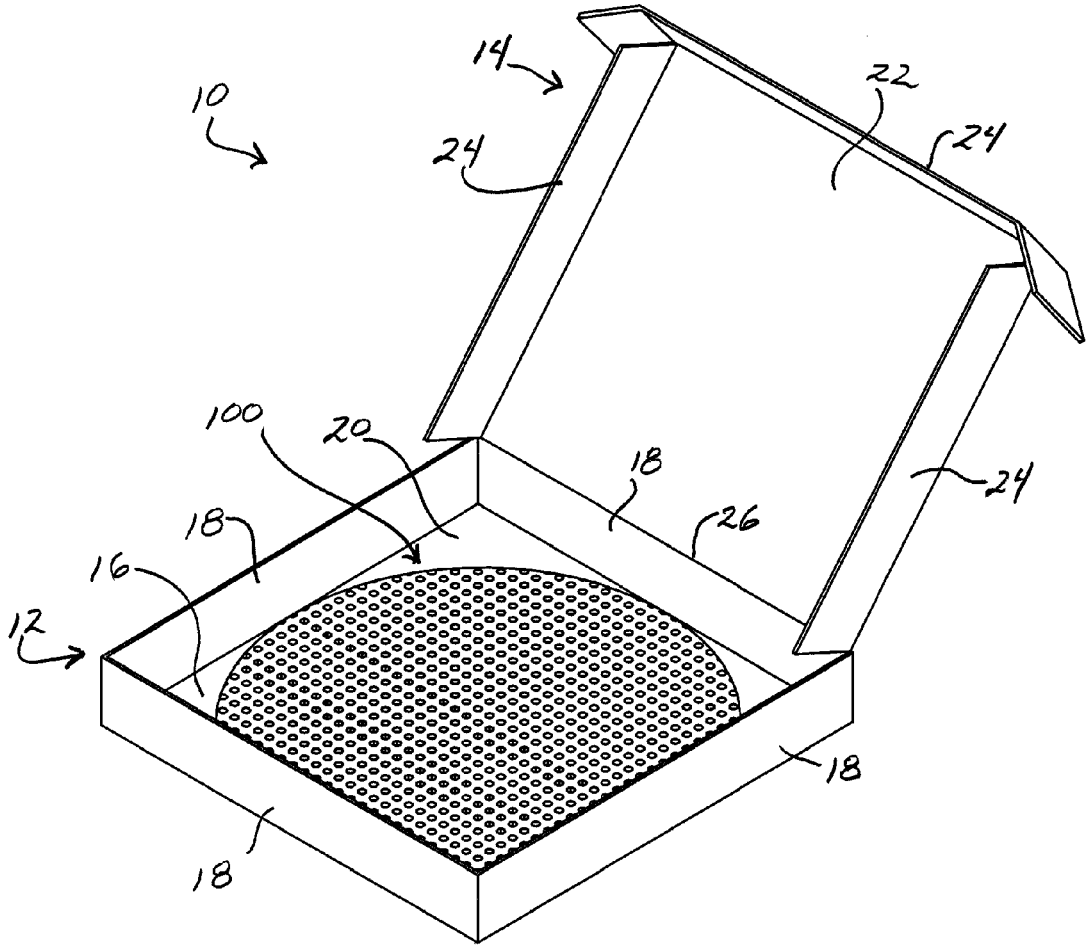
FIG. 1 is a perspective view of a food container, in particular a pizza box, with an embodiment of a circular embossed sheet positioned in the bottom of the container.

Referring to the drawings, wherein like reference numerals designate identical or corresponding parts throughout the several views, FIG. 1 illustrates a food container or package 10, such as a conventional pizza box manufactured from recycled cardboard. Although, the food container 10 is illustrated as a conventional pizza box, it should be appreciated that the container 10 may be any type of food container for any type of food product. In this embodiment, the container 10 includes a bottom portion 12 and a top portion 14. The bottom portion 12 includes a bottom panel 16 surrounded by peripheral sidewalls 18 defining an interior volume 20. The top portion 14 includes a top panel 22 and peripheral front and side flaps 24. The top and bottom portions 12, 14 are hingedly connected along the back side 26 of the box 10.

Figure 2:
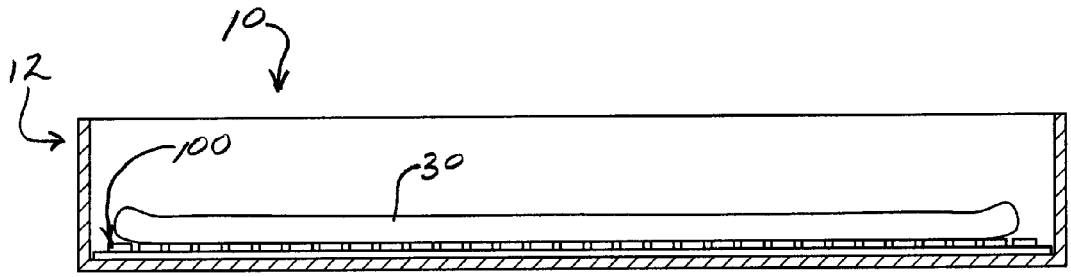
FIG. 2 is a cross-sectional view of the box of FIG. 1 showing a pizza disposed on the embossed sheet.

As illustrated in FIG. 2 an embossed sheet 100 is positioned inside the bottom portion 12 of the container 10 on which the food 30 is then placed. The embossed sheet 100 may comprise any suitable sheet material 101 that is appropriate for food packaging or for coming into contact with food. As such, the sheet material 101 is preferably premium grade solid bleached sulfate (SBS) but may be any other suitable type of paper, paperboard, cardstock or cardboard material or any other type of pulp-based, fiber-based or cellulose-based material, whether from wood, other plant or natural material or from synthetic material. The sheet material preferably has a thickness between about 0.004 and 0.100 inches, and may comprise single or multiple plies. As used herein, the term "embossed" should be understood to include any type of stamping or imprinting that creates a relief or raised surface in the sheet material 101.

Depending on the application and intended use of the embossed sheet 100 and the type of food it is intended to contact, the sheet material 101 may include appropriate barrier coatings as well known to those of skill in the art such that the embossed sheet 100 is "bakeable" or oven-useable for baking, heating, or reheating foods. Additionally, or in the alternative, the embossed sheet 100 may include barrier coating such that it is freezer-to-oven ready and/or impermeable to liquids.

Figure 3:
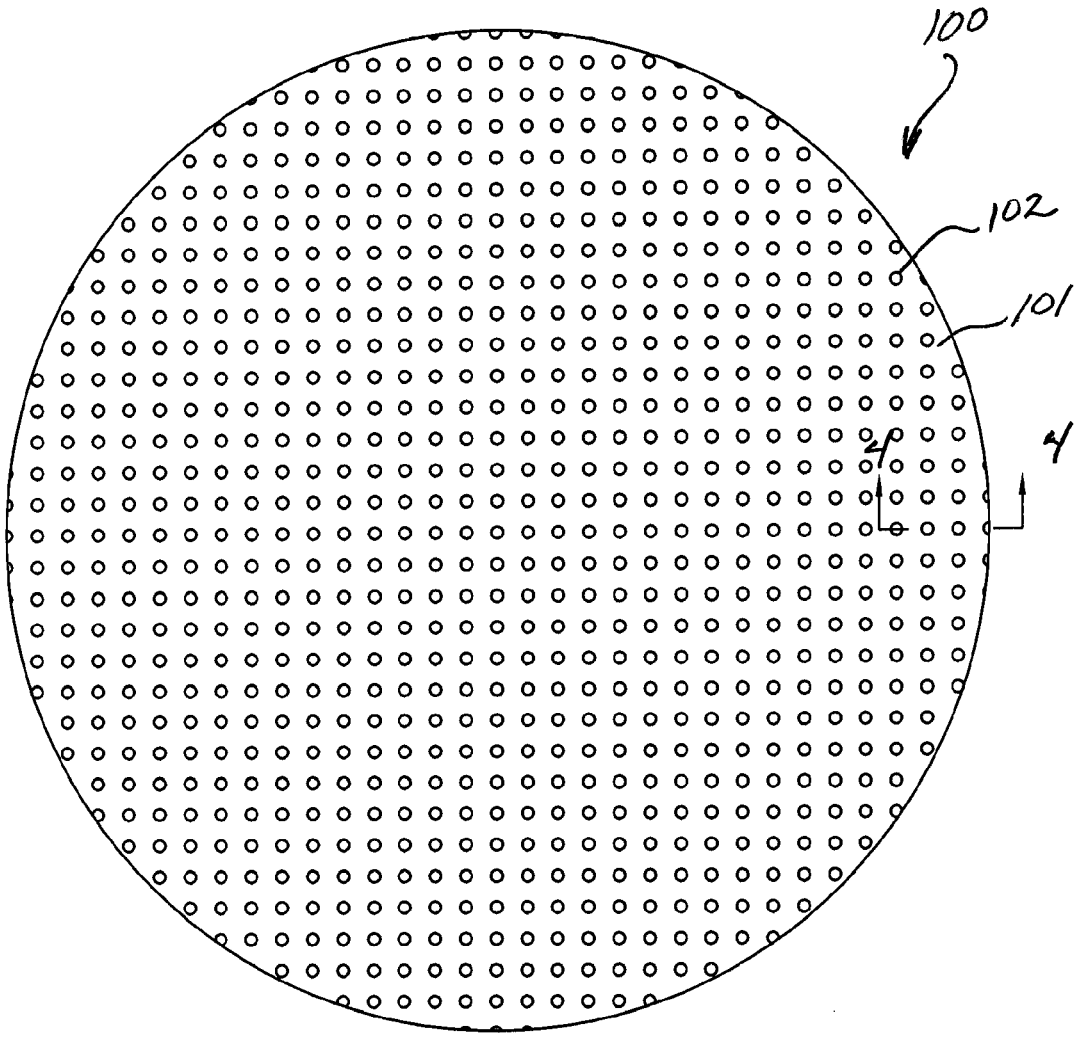
FIG. 3 is a plan view of one embodiment of a circular embossed sheet with an embossing pattern on one side of the sheet material.
Figure 4:
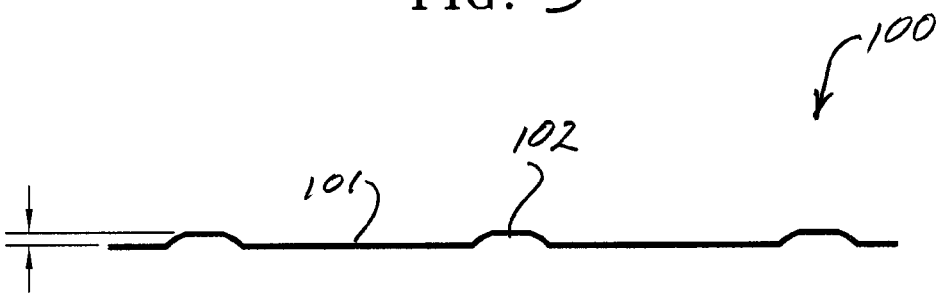
FIG. 4 is a partial cross-sectional view of the embossed sheet as viewed along lines 4-4 of FIG. 3.
Figure 5:
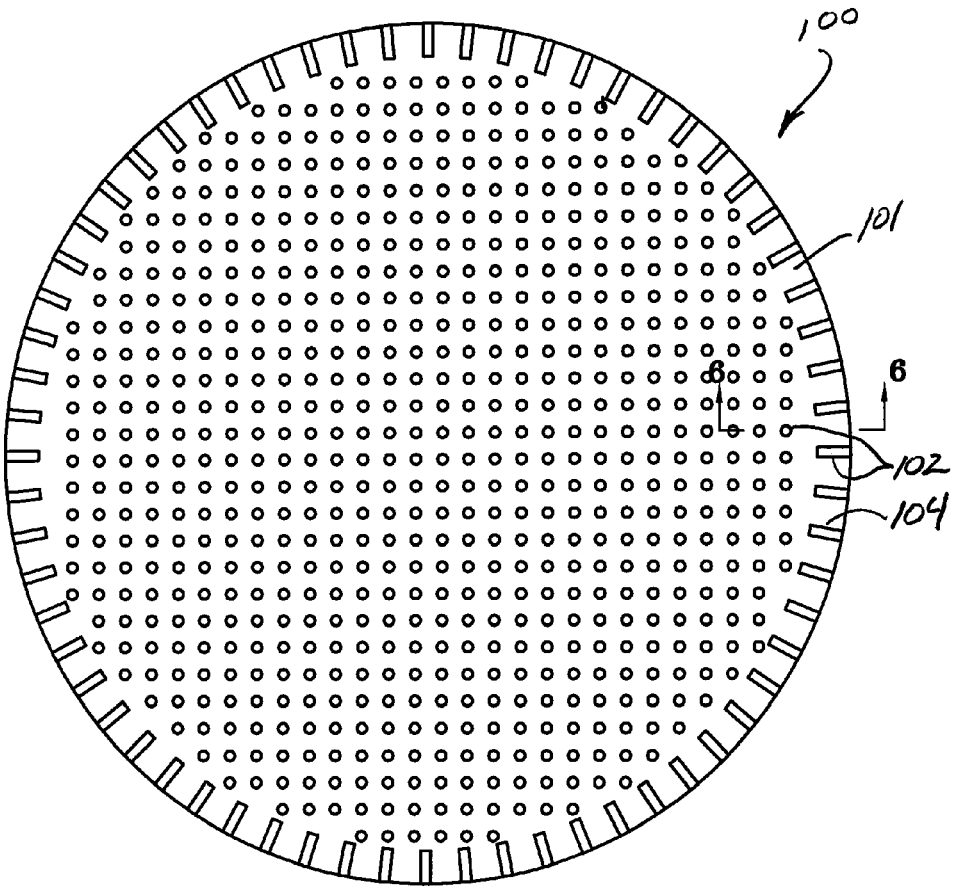
FIG. 5 is a plan view of another embodiment of a circular embossed sheet with an embossing pattern on one side of the sheet material comprising radial ribs.
Figure 6:
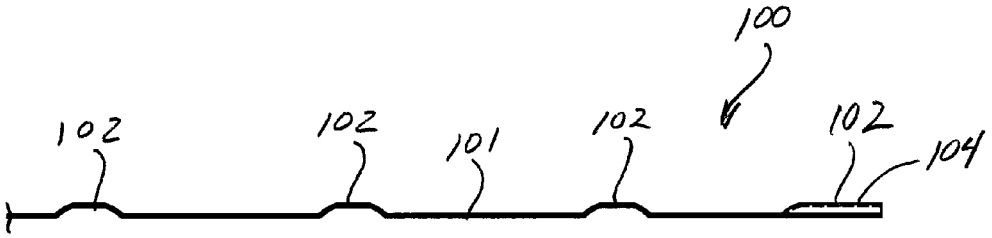
FIG. 6 is a partial cross-sectional view of the embossed sheet as viewed along lines 6-6 of FIG. 5.
Figure 7:
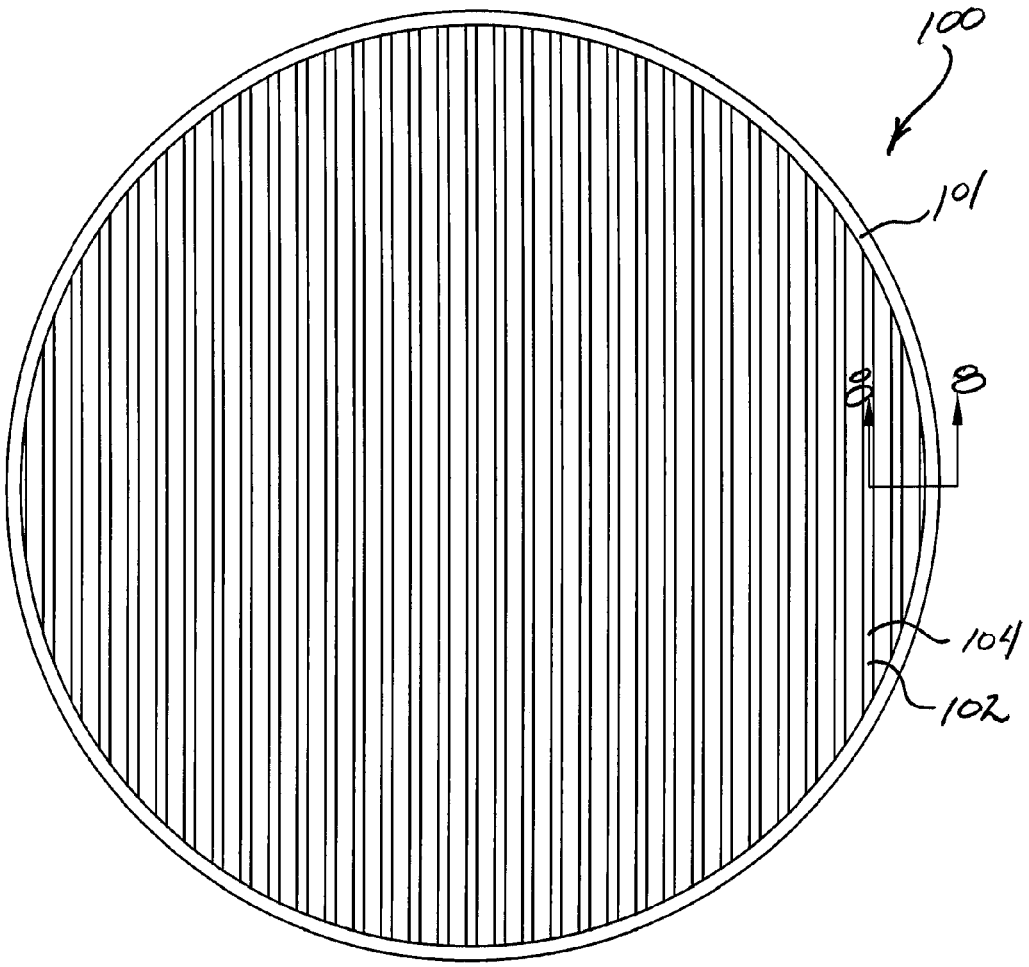
FIG. 7 is a plan view of another embodiment of a circular embossed sheet an embossing pattern on one side of the sheet material comprising transverse ribs.
Figure 8:
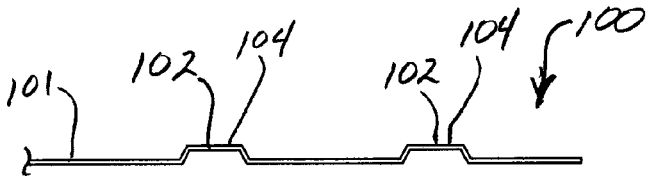
FIG. 8 is a partial cross-sectional view of the embossed sheet as viewed along lines 8-8 of FIG. 7.
Figure 9:
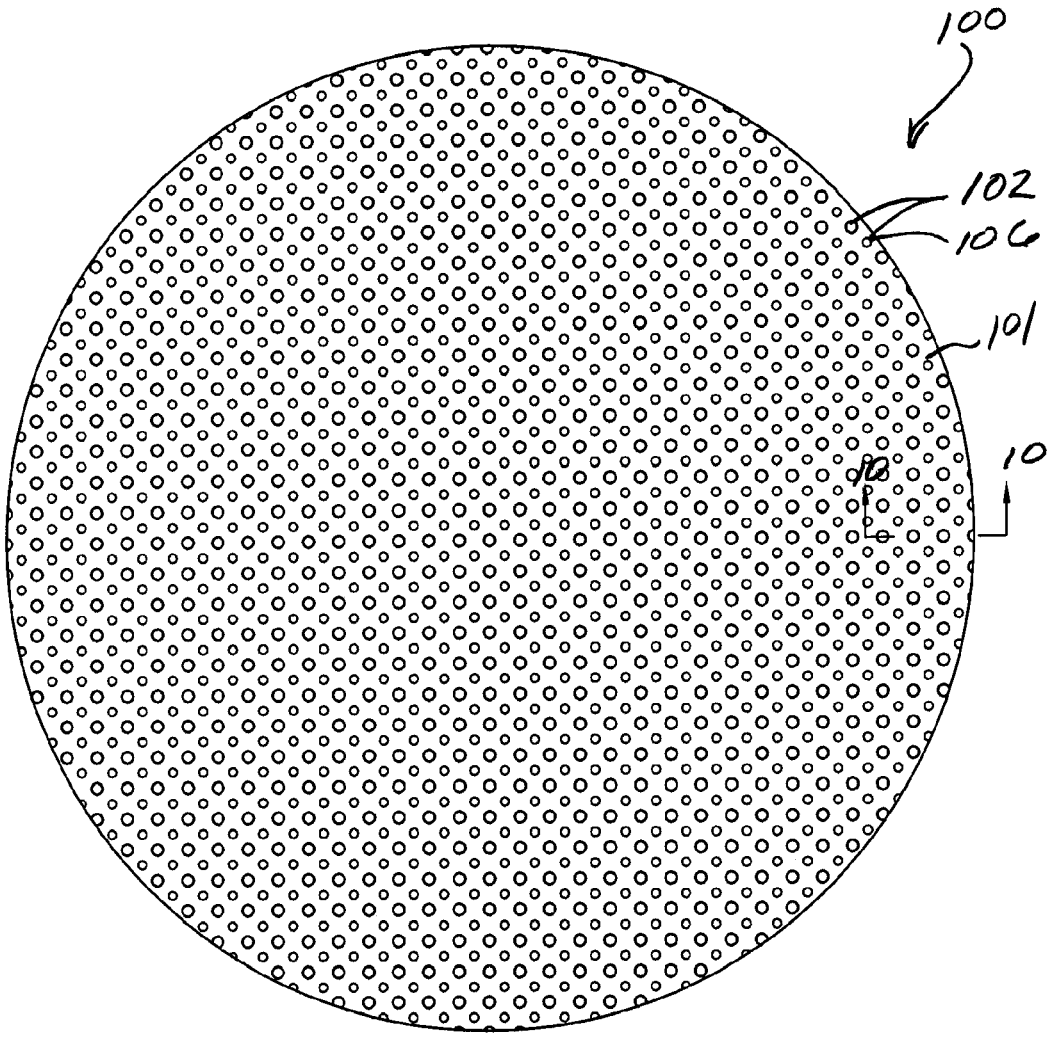
FIG. 9 is a plan view of another embodiment of a circular embossed sheet with an embossing pattern on each side of the sheet material.
Figure 10:
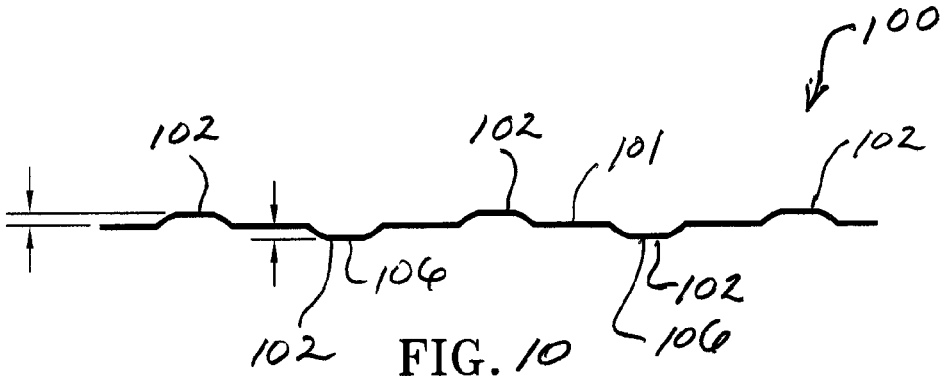
FIG. 10 is a partial cross-sectional view of the embossed sheet as viewed along lines 10-10 of FIG. 9.
Figure 11:
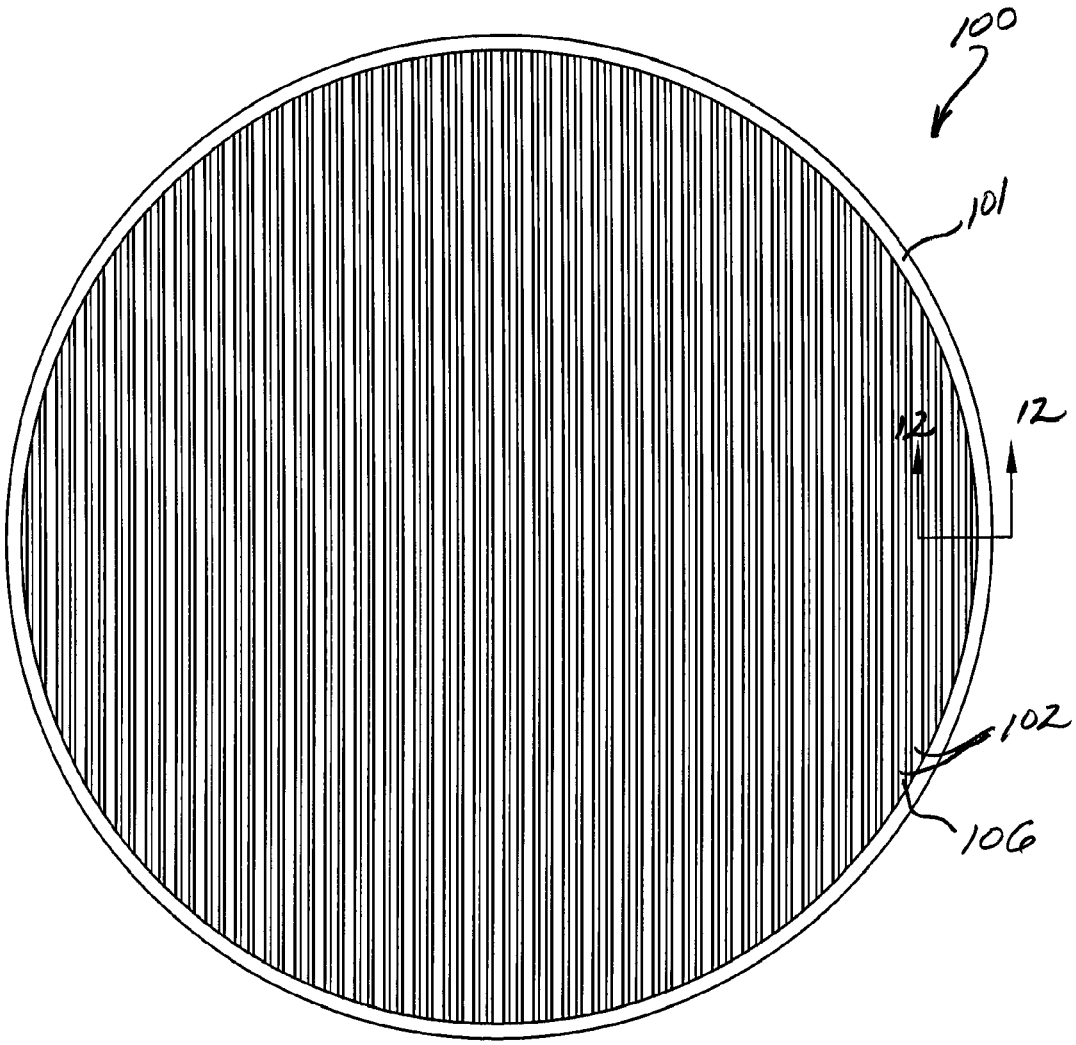
FIG. 11 is a plan view of another embodiment of a circular embossed sheet with an embossing pattern on both sides of the sheet material comprising transverse ribs.
Figure 12:
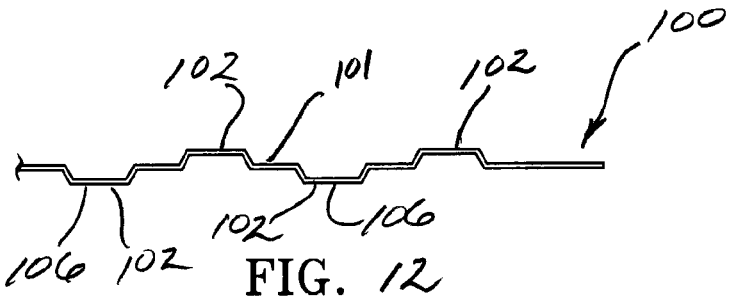
FIG. 12 is a partial cross-sectional view of the embossed sheet as viewed along lines 12-12 of FIG. 11.
Figure 13:
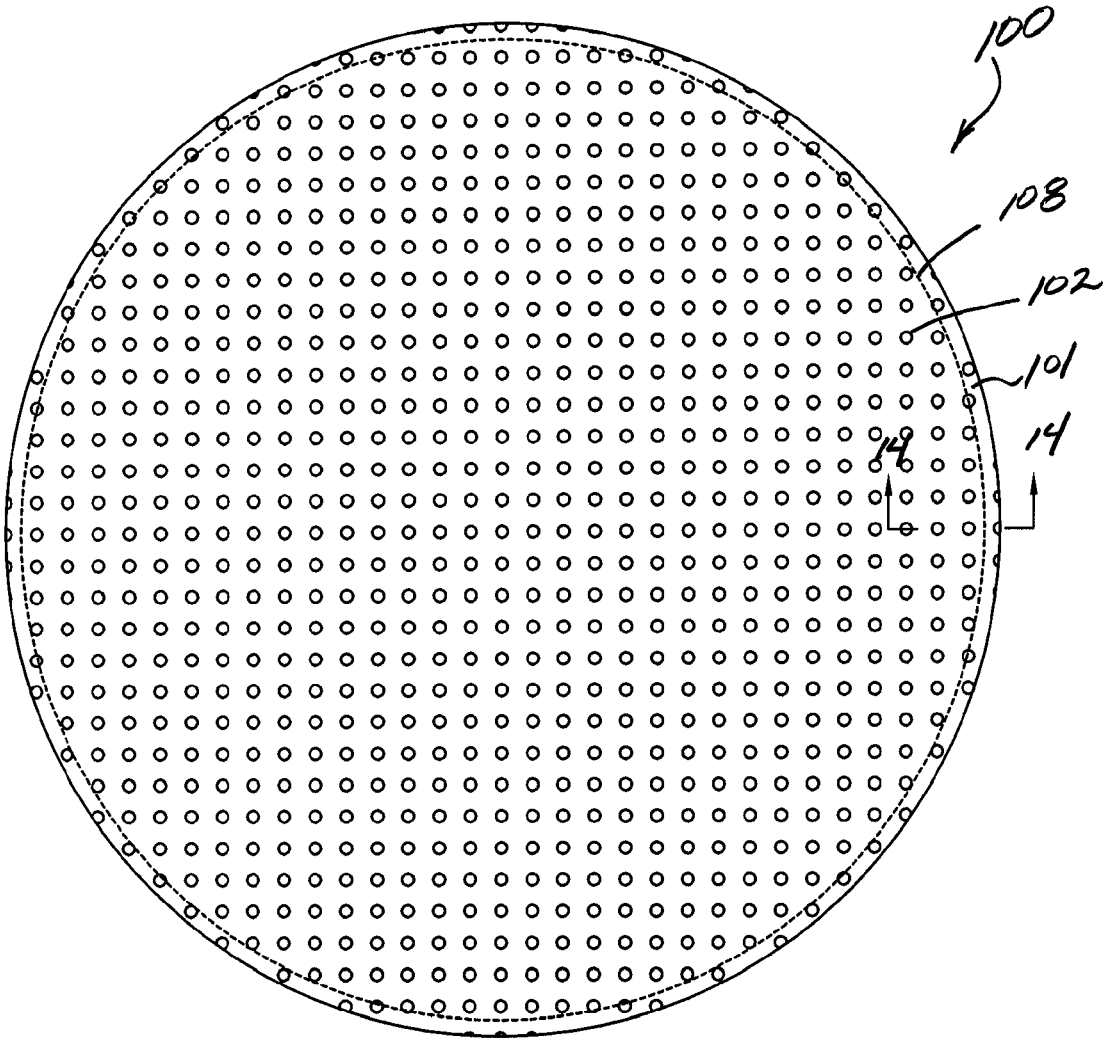
FIG. 13 is a plan view of another embodiment of a circular embossed sheet with an embossing pattern on one side of the sheet material and a peripheral score line.
Figure 14:
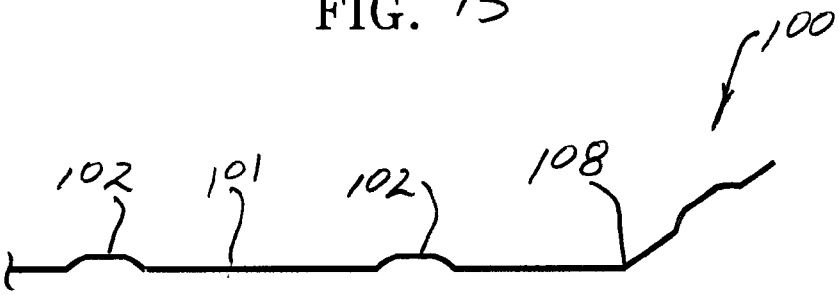
FIG. 14 is a partial cross-sectional view of the embossed sheet as viewed along lines 14-14 of FIG. 13.
Figure 15:
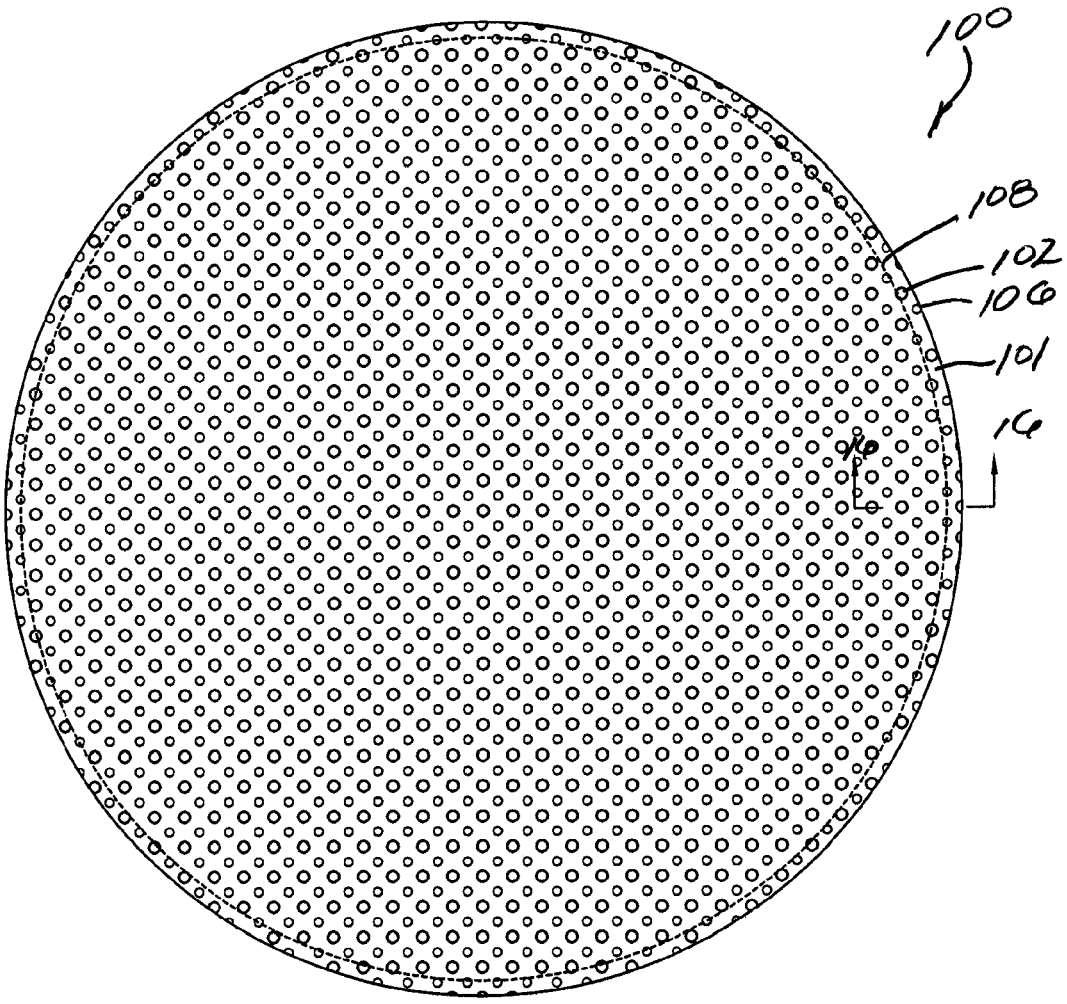
FIG. 15 is a plan view of another embodiment of a circular embossed sheet with an embossing pattern on each side of the sheet material and a peripheral score line.
Figure 16:
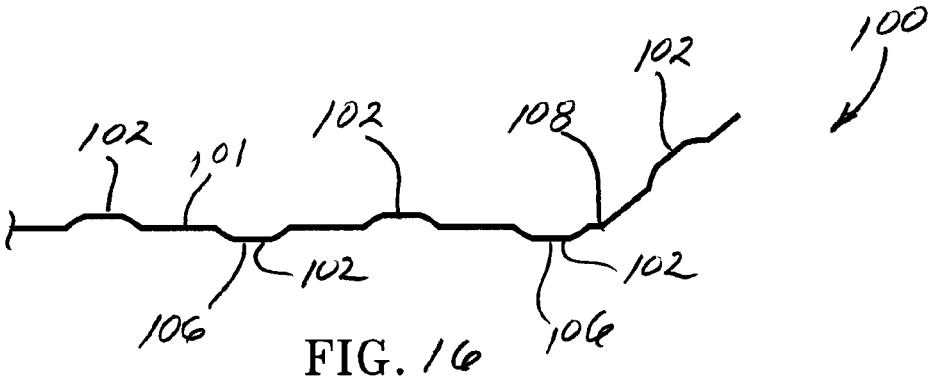
FIG. 16 is a partial cross-sectional view of the embossed sheet as viewed along lines 16-16 of FIG. 15.
Figure 17:
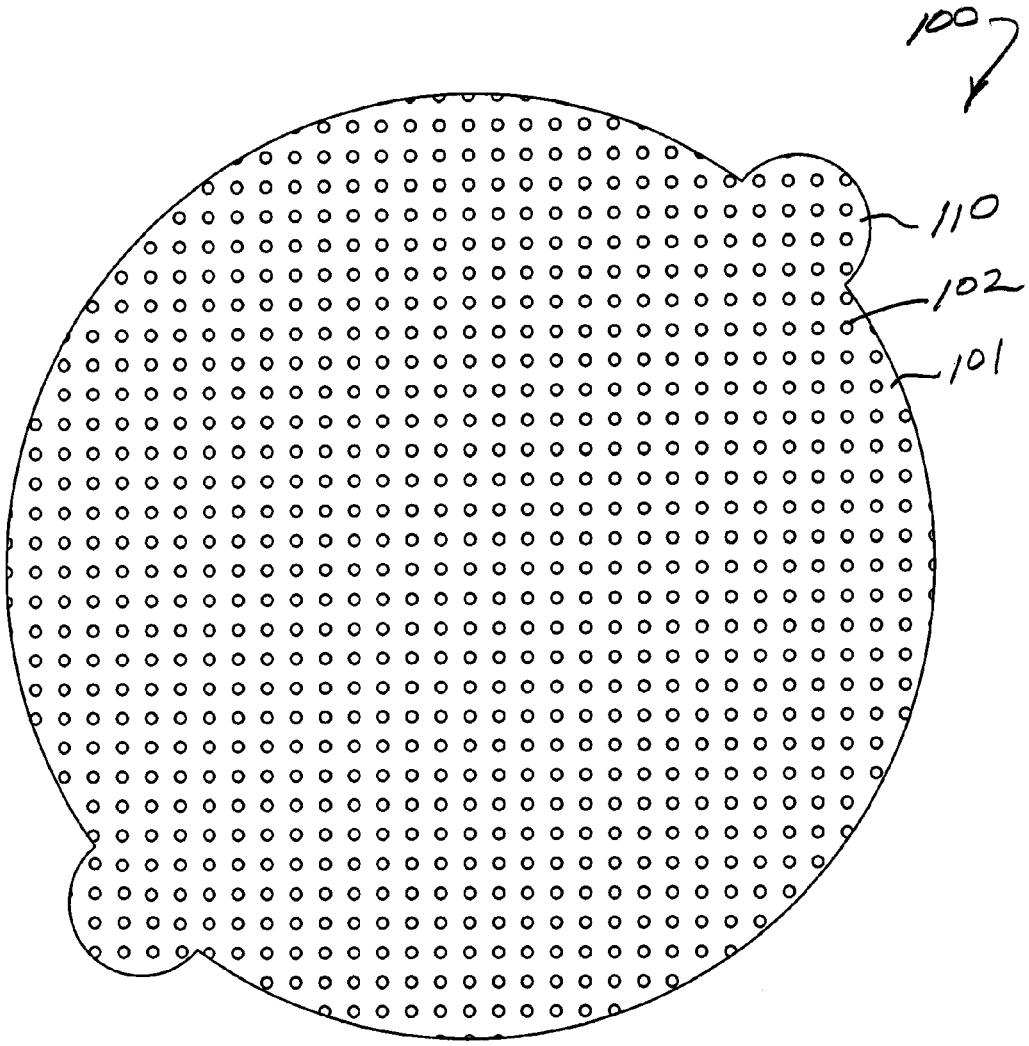
FIG. 17 is a plan view of another embodiment of a circular embossed sheet with an embossing pattern on one side of the sheet material and two handle tabs.
Figure 18:
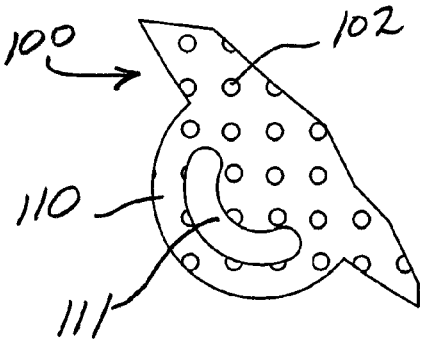
FIG. 18 shows an alternative embodiment of a handle tab with a cutout.
Figure 19:
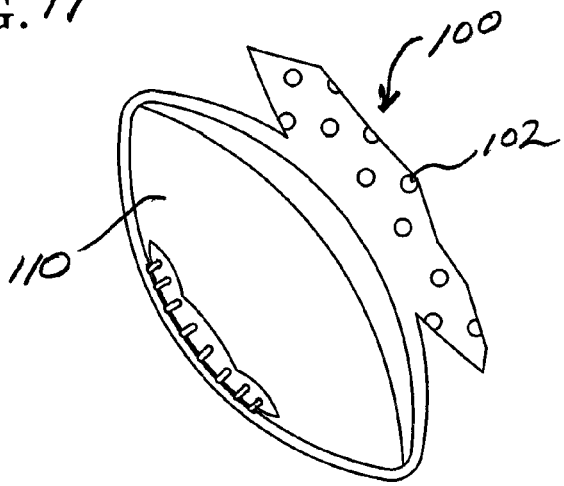
FIG. 19 shows an alternative embodiment of a handle tab configured and embossed to resemble a football.
Figure 20:
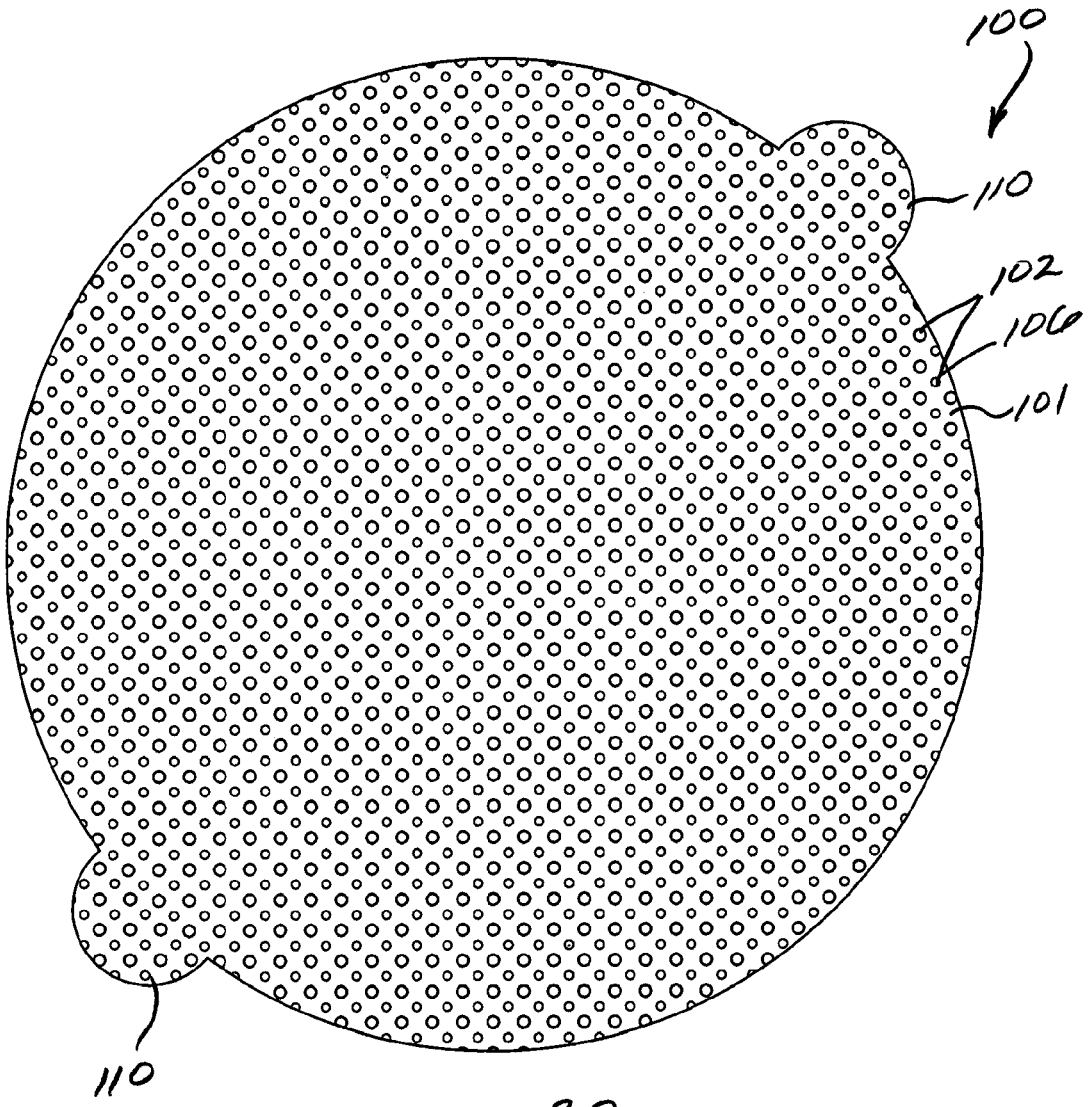
FIG. 20 is a plan view of another embodiment of a circular embossed sheet with an embossing pattern on each side of the sheet material and two handle tabs.
Figure 21:
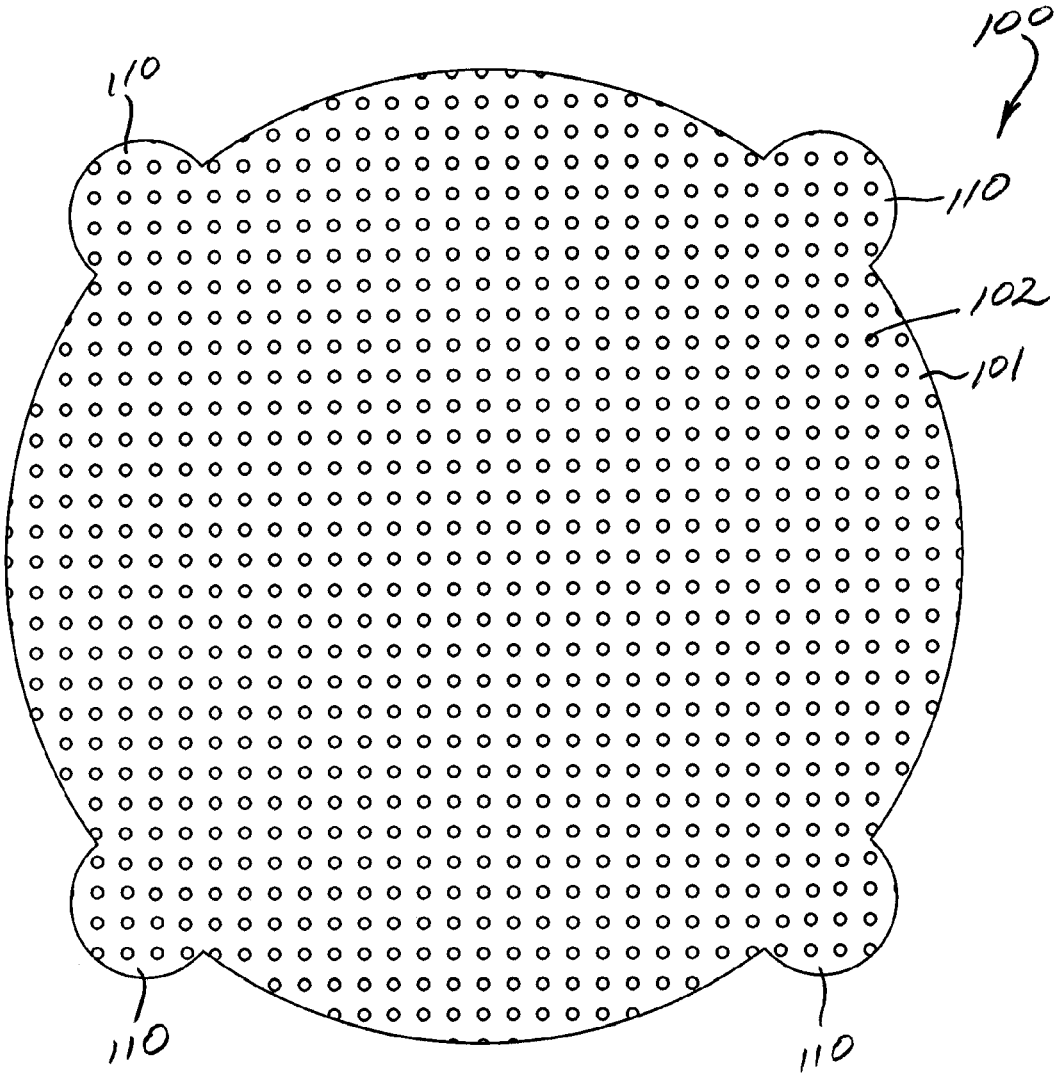
FIG. 21 is a plan view of another embodiment of a circular embossed sheet with an embossing pattern on one side of the sheet material and four handle tabs.
Figure 22:
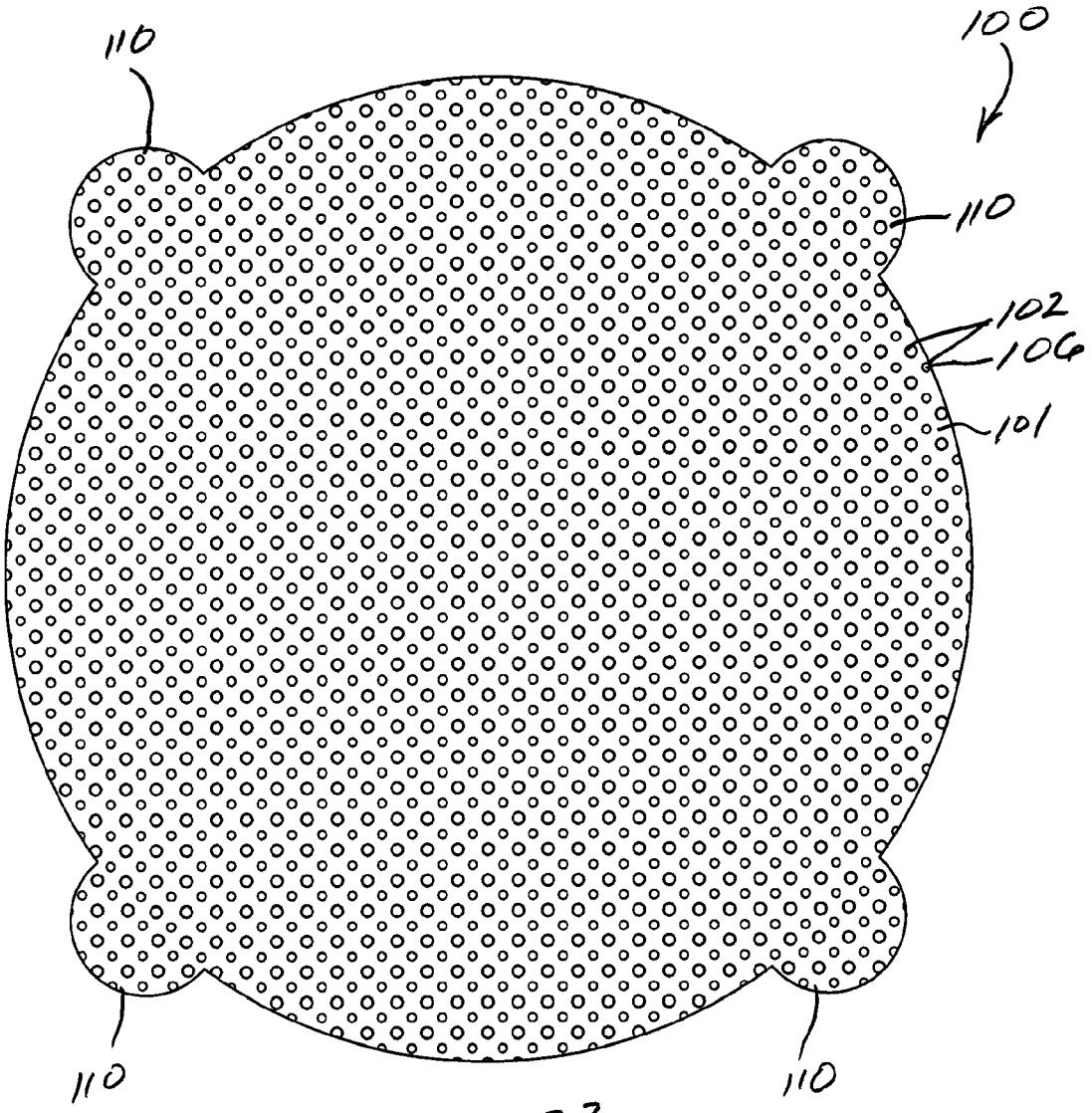
FIG. 22. is a plan view of another embodiment of a circular embossed sheet with an embossing pattern on each side of the sheet material and four handle tabs.
Figure 23:
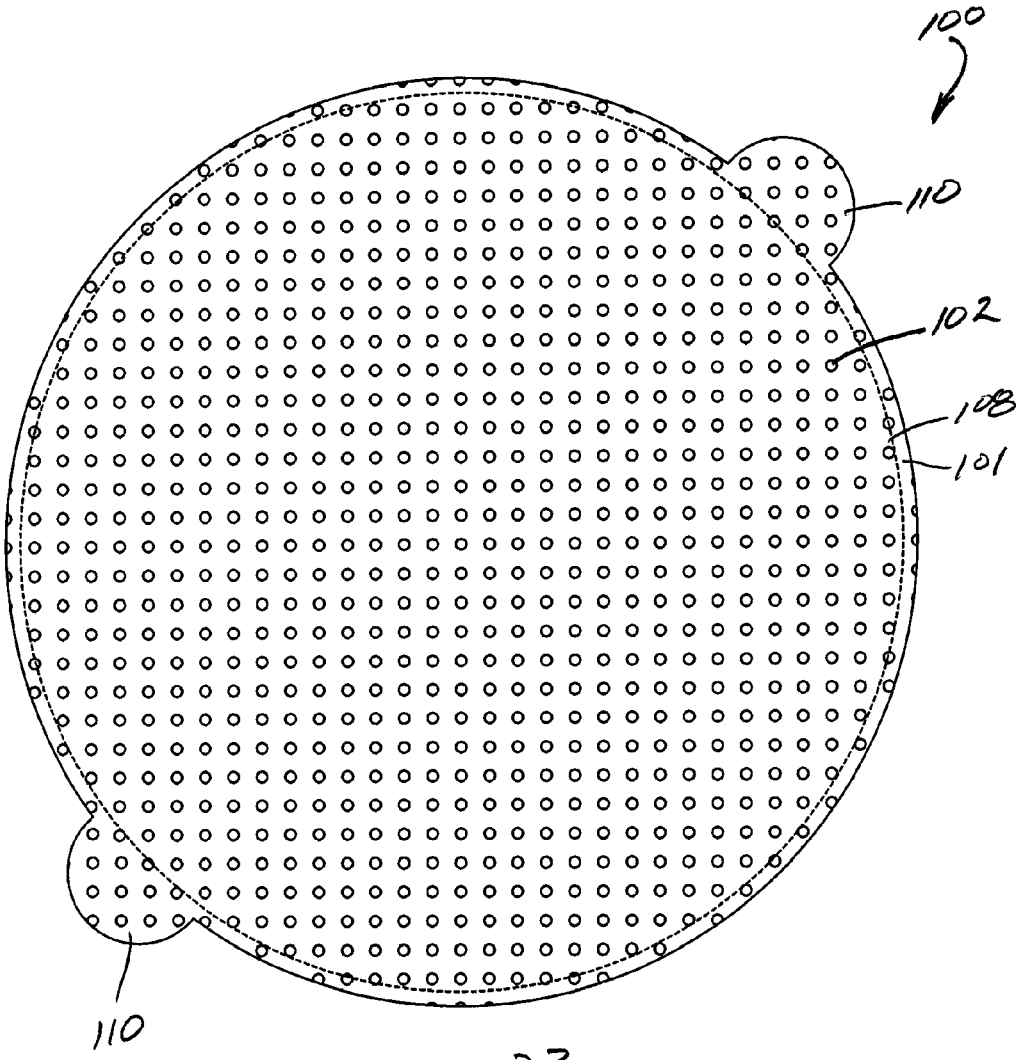
FIG. 23 is a plan view of another embodiment of a circular embossed sheet with an embossing pattern on one side of the sheet material, a peripheral score line and two handle tabs.
Figure 24:
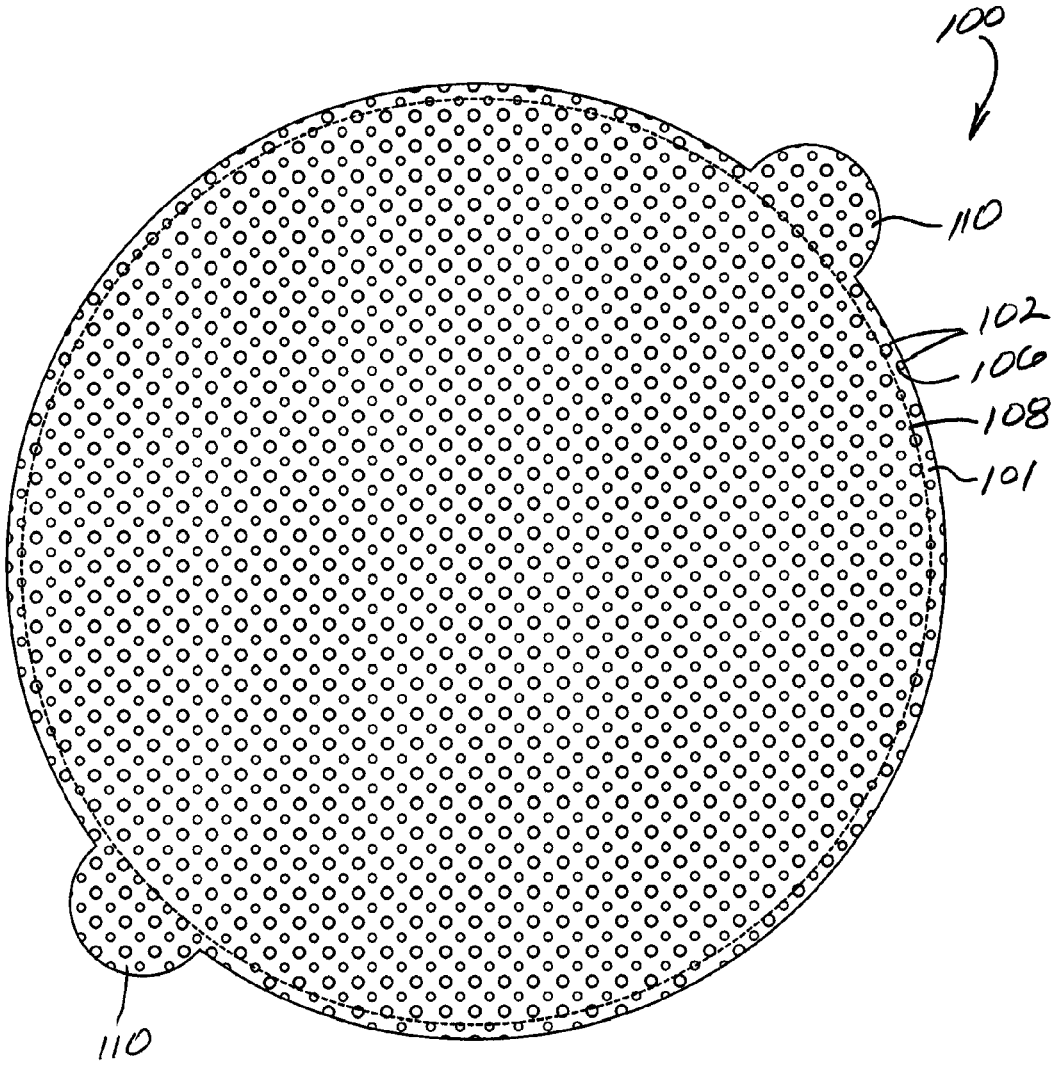
FIG. 24 is a plan view of another embodiment of a circular embossed sheet with an embossing pattern on each side of the sheet material, a peripheral score line and two handle tabs.
Figure 25:
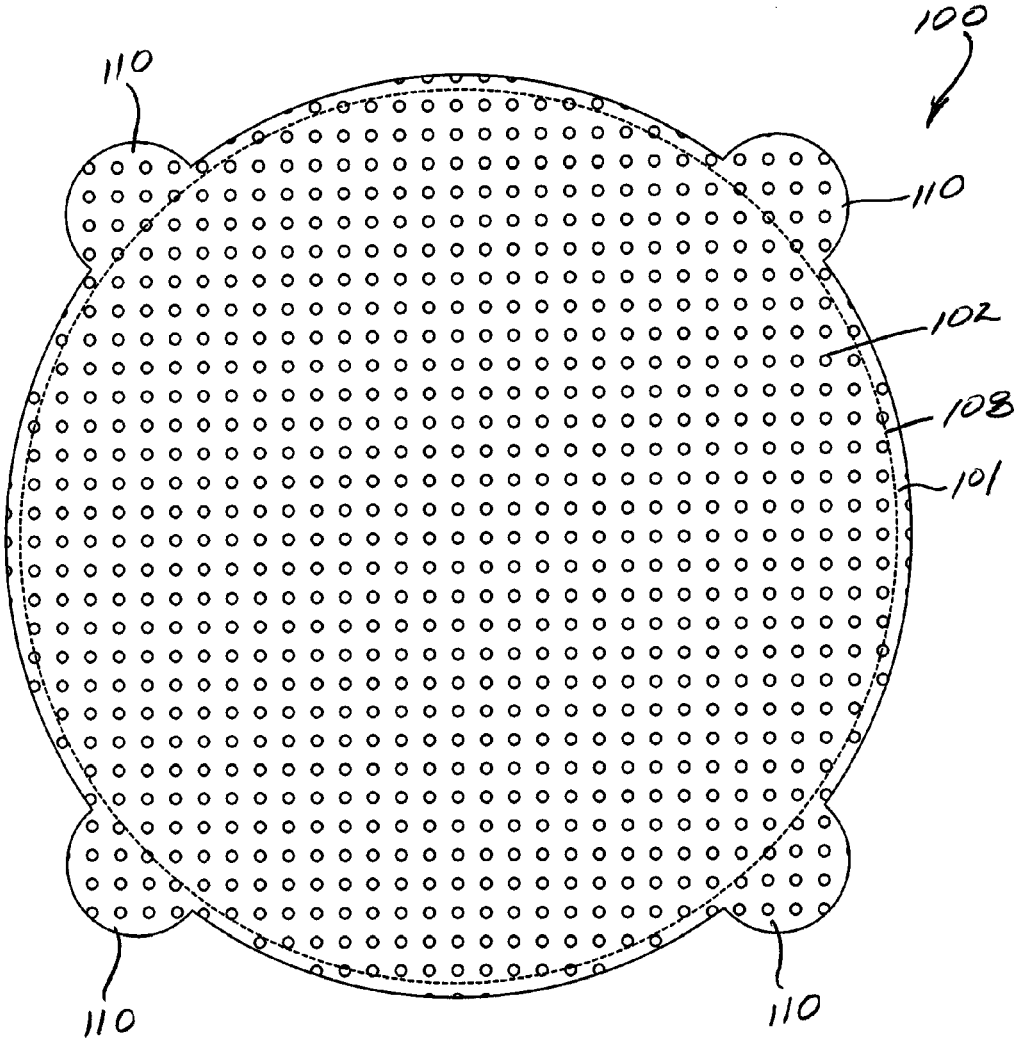
FIG. 25 is a plan view of another embodiment of a circular embossed sheet with an embossing pattern on one side of the sheet material, a peripheral score line and four handle tabs.
Figure 26:
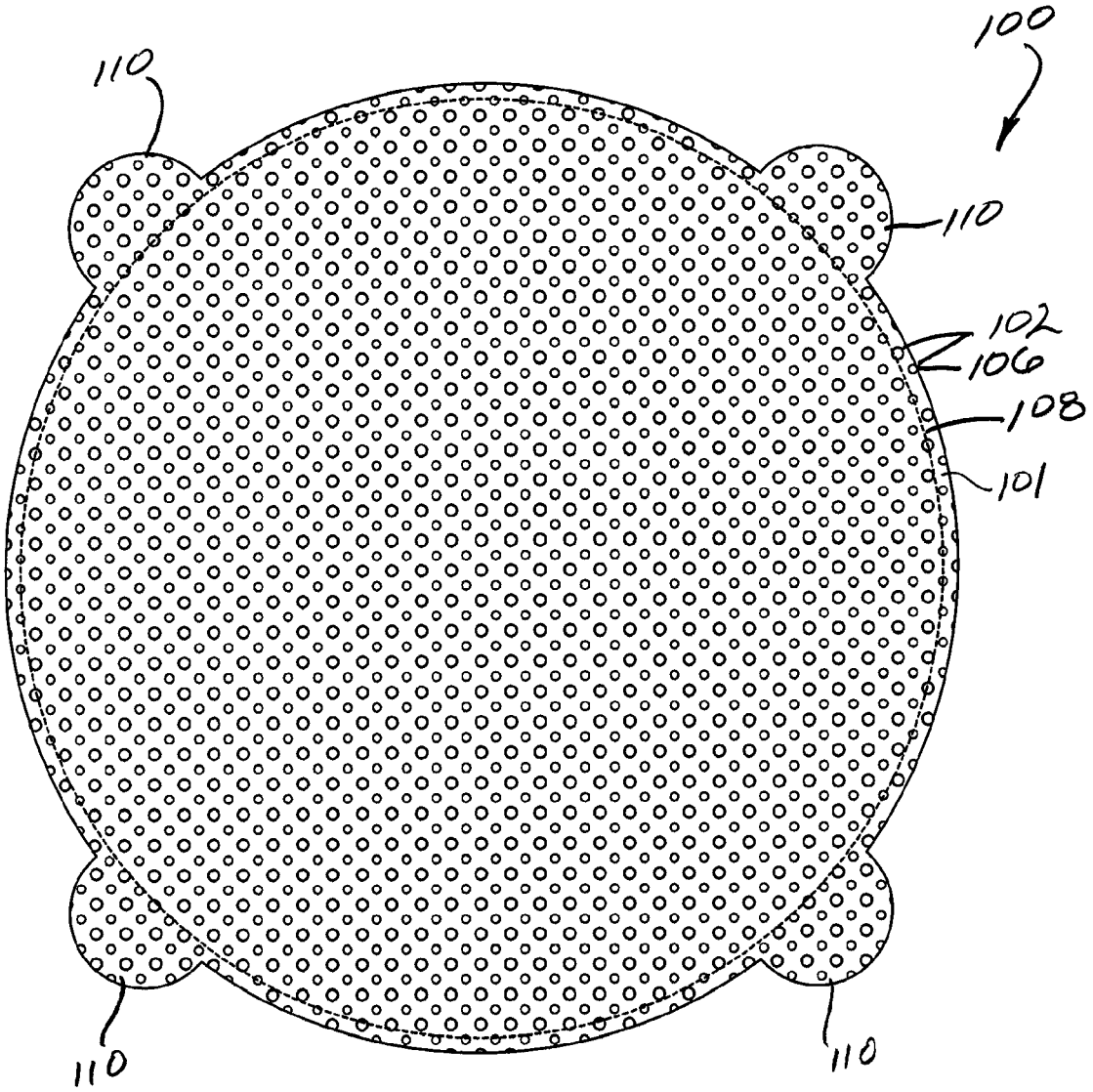
FIG. 26 is a plan view of another embodiment of a circular embossed sheet with an embossing pattern on each side of the sheet material, a peripheral score line and four handle tabs.

The embossed sheet 100 may have an embossing pattern comprising projections 102 having any suitable configuration, size and spacing. As an example, as shown in FIGS. 3-4, projections having a diameter of 3/16 inches, a height range between 0.010 to 0.040 inches, and spaced at ½ inches may be suitable. Alternatively, as shown in FIGS. 5-8, for example, the projections 102 may take the form of elongated ribs 104 arranged in a radial pattern (FIG. 5) or extending transversely across the sheet (FIG. 7), or any other desired pattern. Additionally, as shown in FIGS. 9-12, the embossed sheet 100 may have embossing on both sides of the sheet so that the respective projections 102 on each side of the sheet appear as depressions 106 from the opposite side of the sheet. Thus, it should be appreciated that the particular configuration, size, spacing and pattern of the projections 102 may vary as desired depending on design preferences as well as on the process used to produce the embossed sheet 100 (discussed later) and/or on the thickness and other properties of the sheet.

The embossed sheet 100 may be used for a number of purposes. As shown in FIGS. 1 and 2, the embossed sheet 100 may be inserted into a pizza box or other food container 10 to serve as a barrier between the food 30 and the recycled cardboard box to minimize potential migration of deleterious substances from the recycled material to the food. The embossed sheet 100 may take the shape of the food product, such as a circular shape for a pizza, for example, or the embossed sheet 100 may take the shape of the container 10, or any other desired shape.

In addition to serving as a barrier between a food product and its container 10, the projections 102 of the embossed sheet 100 serve to intermittently support the food product 30 thereby allowing some air circulation below the food product so the food does not become soggy due to the collection of condensation, drippings or juices from the food within the container 10. The projections 102 also provide an air space which minimizes heat transfer via conduction to the surrounding container. Furthermore, for embossed sheets 100 embossed on both sides, the depressions 106 may permit additional air circulation and serve as small wells in which condensation, food juices or drippings are collected.

It has also been found that the embossed sheet 100 improves the quality of certain foods when reheating or baking, presumably due to the projections 102 creating an air space and allowing more air circulation below the food. For example it has been found that if a conventional flat (non-embossed) oven-ready paperboard or corrugated pizza tray is embossed as described herein, and if this embossed sheet 100 is then used to bake the pizza, the resulting crust is more uniformly cooked, is crispier and has a more uniform golden-brown crust. It was also found that if a black colored, conventional flat (non-embossed) oven-ready paperboard or corrugated pizza tray is embossed as described herein so as to create a black embossed paperboard sheet 100, the resulting crust is even crispier and more golden-brown.

As shown in FIGS. 13-16, the embossed sheet 100 may include a score line 108 to form a shallow tray with an upwardly angled lip around the outer periphery to minimize liquid from the food product placed thereon from dripping into the oven or from dripping onto to the table or countertop before serving.

As shown in FIGS. 17-28, the embossed sheet 100 may include one or more sets of handle tabs 110 which may serve as handles in which to lift the embossed sheet 100 and the food product out of the container or to serve as handles when carrying and serving the food from the embossed sheet 100 like a serving tray. Additionally, if the embossed sheet 100 is used for reheating or baking food in an oven, the handle tabs 110 may be used as handles to remove the sheet and food from the oven. The handle tabs 110 may include a cutout 111 (FIG. 18) so the handle tab 110 is easier to grasp or hold. Although the drawing figures show the use of two or four tabs 110, any number of tabs of any desired size or configuration may be used. For example, the tabs 110 may be formed in the shape of a company logo and/or embossed with a logo or trademark. As another example, the tabs 110 may be shaped and/or embossed to promote a holiday, sporting event, or other occasion. As an example, if the embossed sheet 100 is used as an insert in a pizza box, the handle tabs 110 may be formed and embossed as a football (see FIG. 19) during the football season, a baseball during baseball season, a jack-o-lantern during Halloween, etc.

Figure 27:
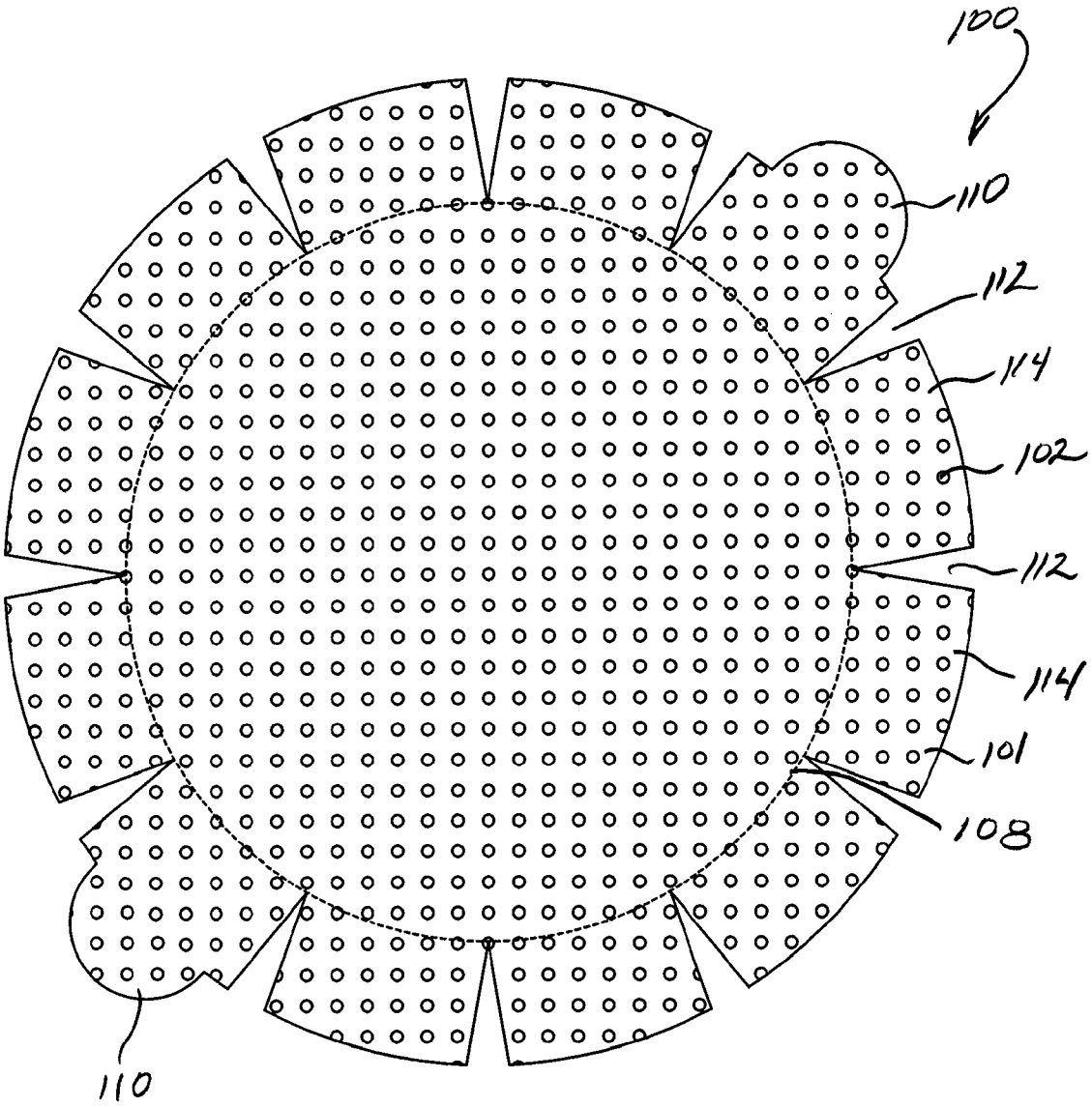
FIG. 27 is a plan view of another embodiment of a circular embossed sheet for insertion into a pan wherein the embossed sheet has an embossing pattern on one side of the sheet material, a peripheral score line, two handle tabs and cutouts.
Figure 28:
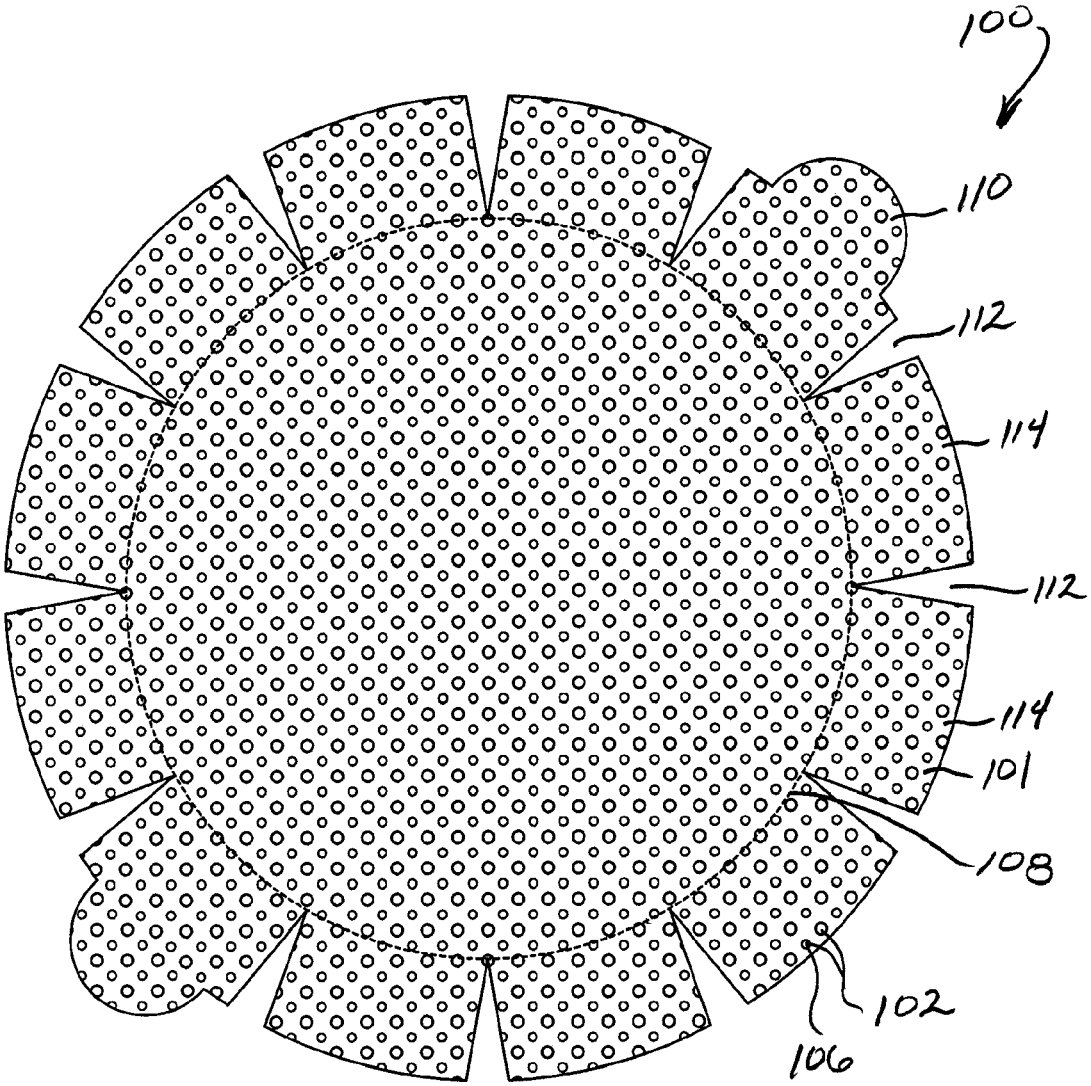
FIG. 28 is a plan view of another embodiment of a circular embossed sheet for insertion into a deep pan wherein the embossed sheet includes an embossing pattern on each side of the sheet material, a peripheral score line, two handle tabs and cutouts.

As shown in FIGS. 27-28, if the embossed sheet 100 is to be inserted into a pan, such as a pizza pan for baking pizza, the embossed sheet 100 may include radial, pie-shaped cut-out sections 112 to allow the remaining flaps 114 to bend up without overlapping and/or so the embossed sheet 100 fits better into the pan. A score line 108 may also be provided to allow the flaps 114 to bend upward at the desired location.

Figure 29:
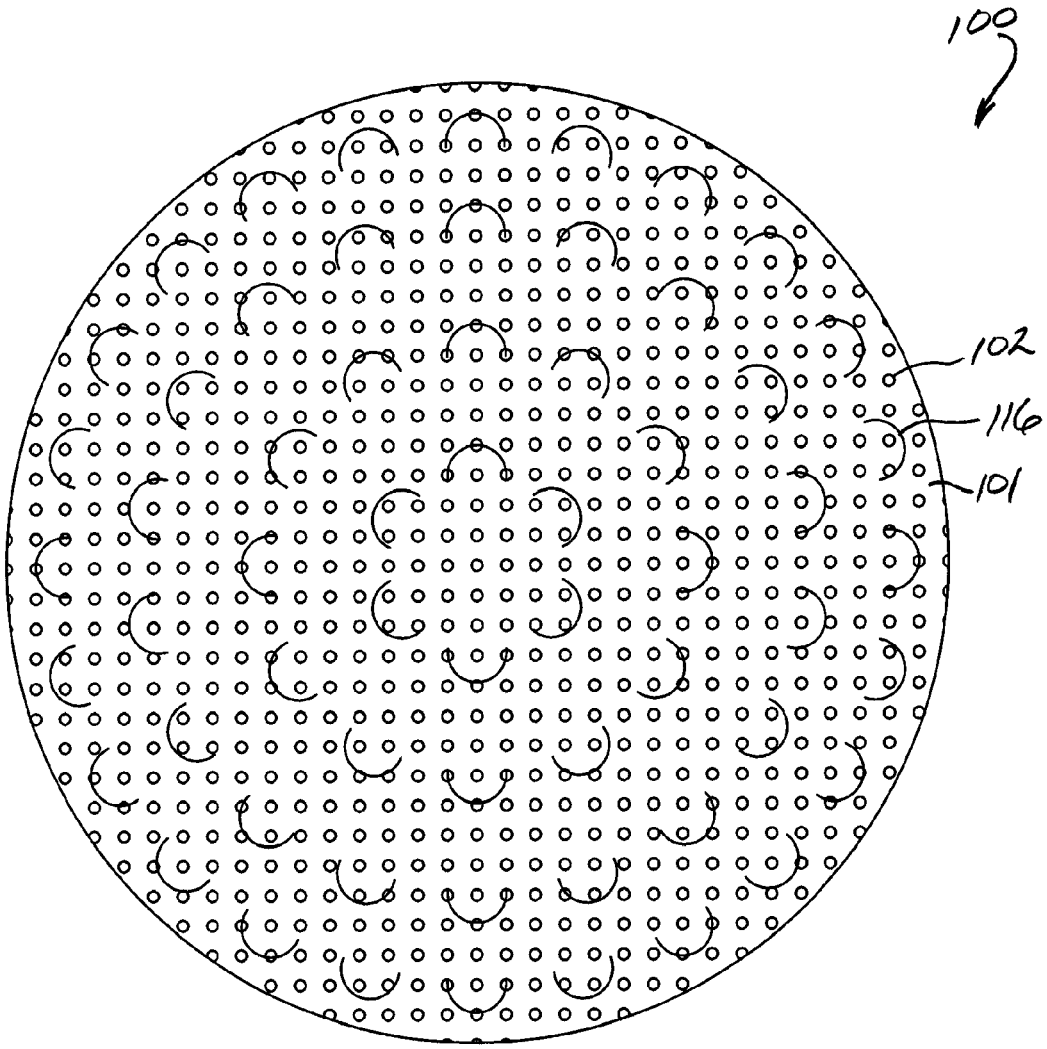
FIG. 29 is a plan view of another embodiment of a circular embossed sheet with an embossing pattern on one side of the sheet material and arcuate vent cuts.
Figure 30:
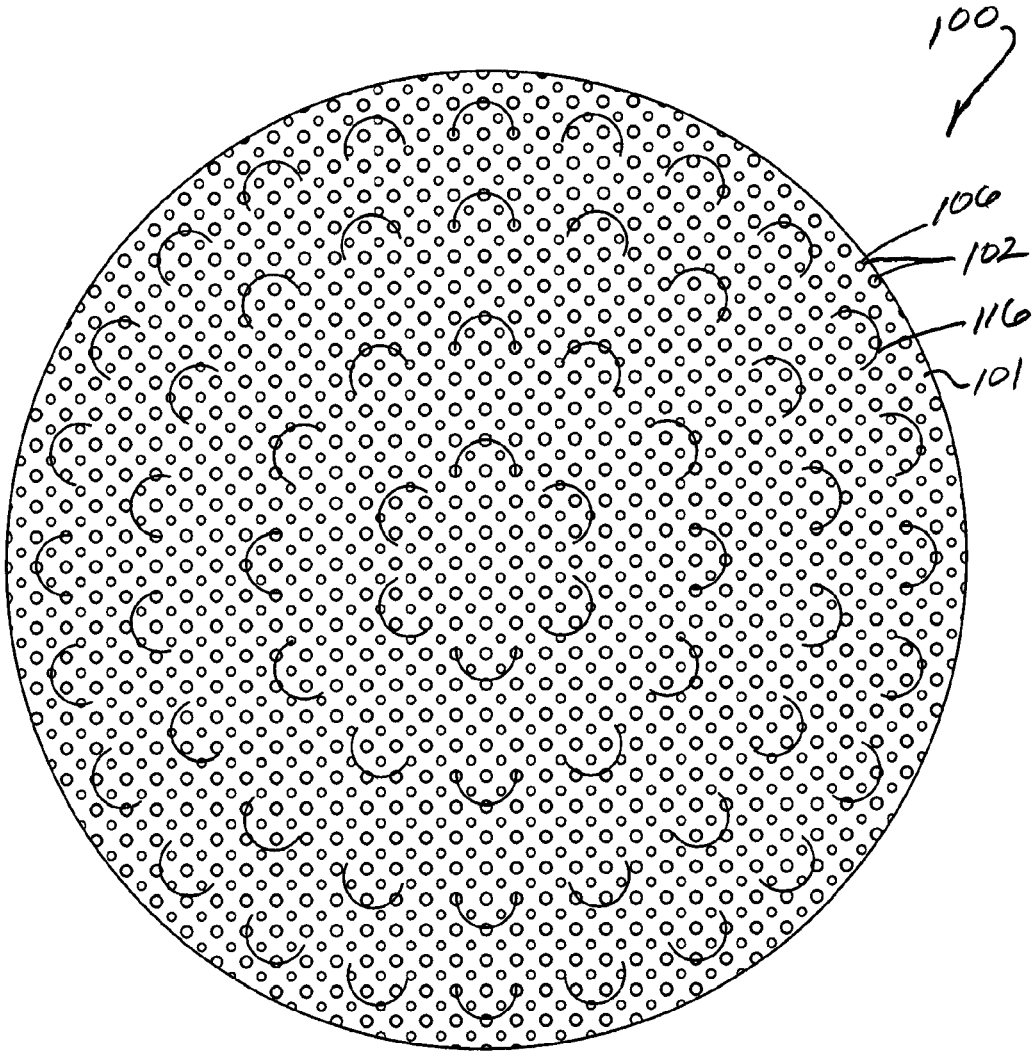
FIG. 30 is a plan view of another embodiment of a circular embossed sheet with an embossing pattern on each side of the sheet material and arcuate vent cuts.

FIGS. 29-30 illustrates yet another embodiment of an embossed sheet 100 which includes vent cuts 116 to permit venting or air circulation through the sheet material 101. The vent cuts 116 may be any desired shape and in any desired arrangement. As illustrated in FIGS. 29-30, the vent cuts 116 are shown as half-moon or arcuate cuts arranged in spaced concentric circles. The embodiments of FIGS. 29-30 may be particularly suited for use in a pizza delivery box, for example.

Figure 31:
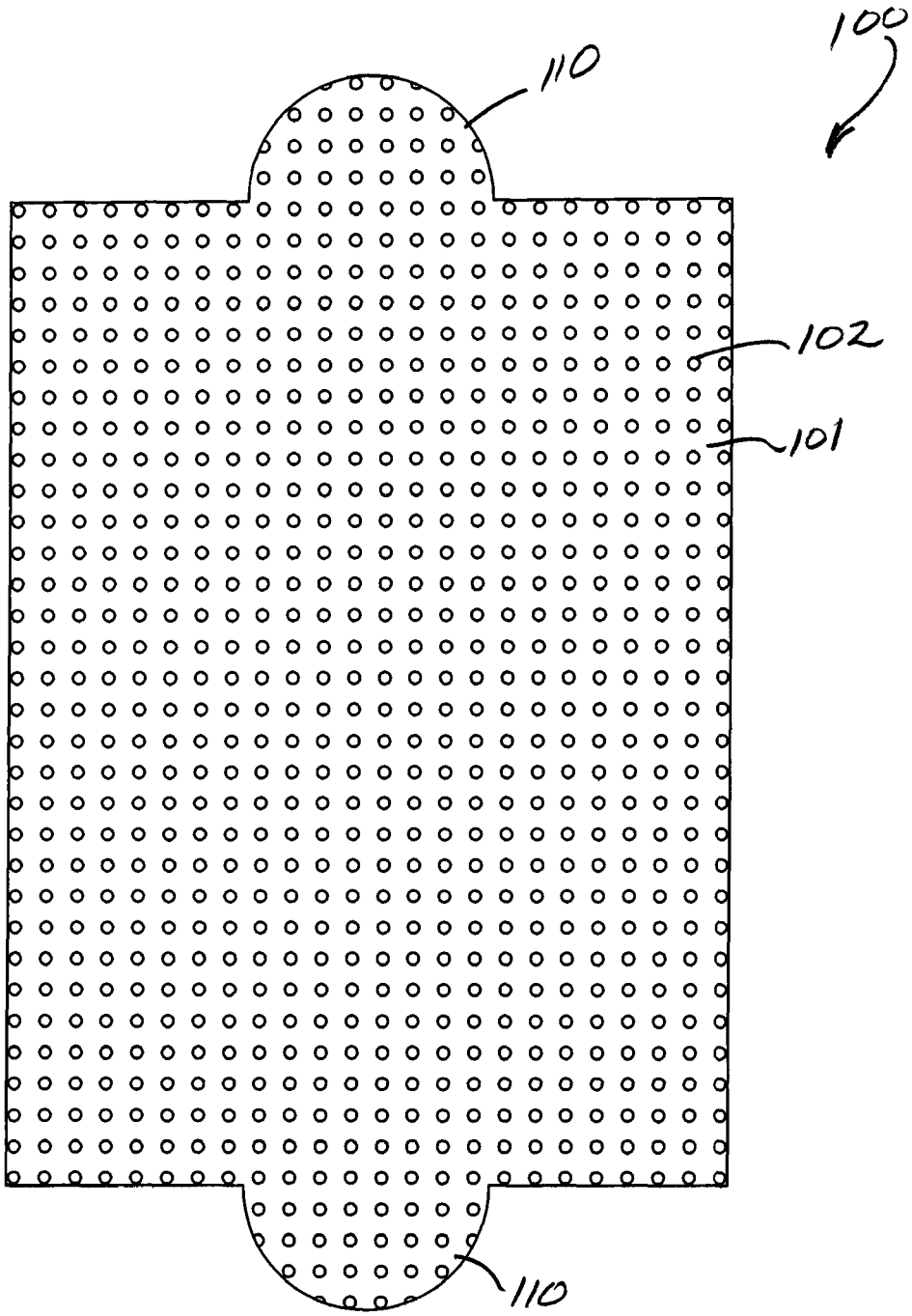
FIG. 31 is a plan view of another embodiment of a rectangular embossed sheet with an embossing pattern on one side of the sheet material and two handle tabs.
Figure 32:
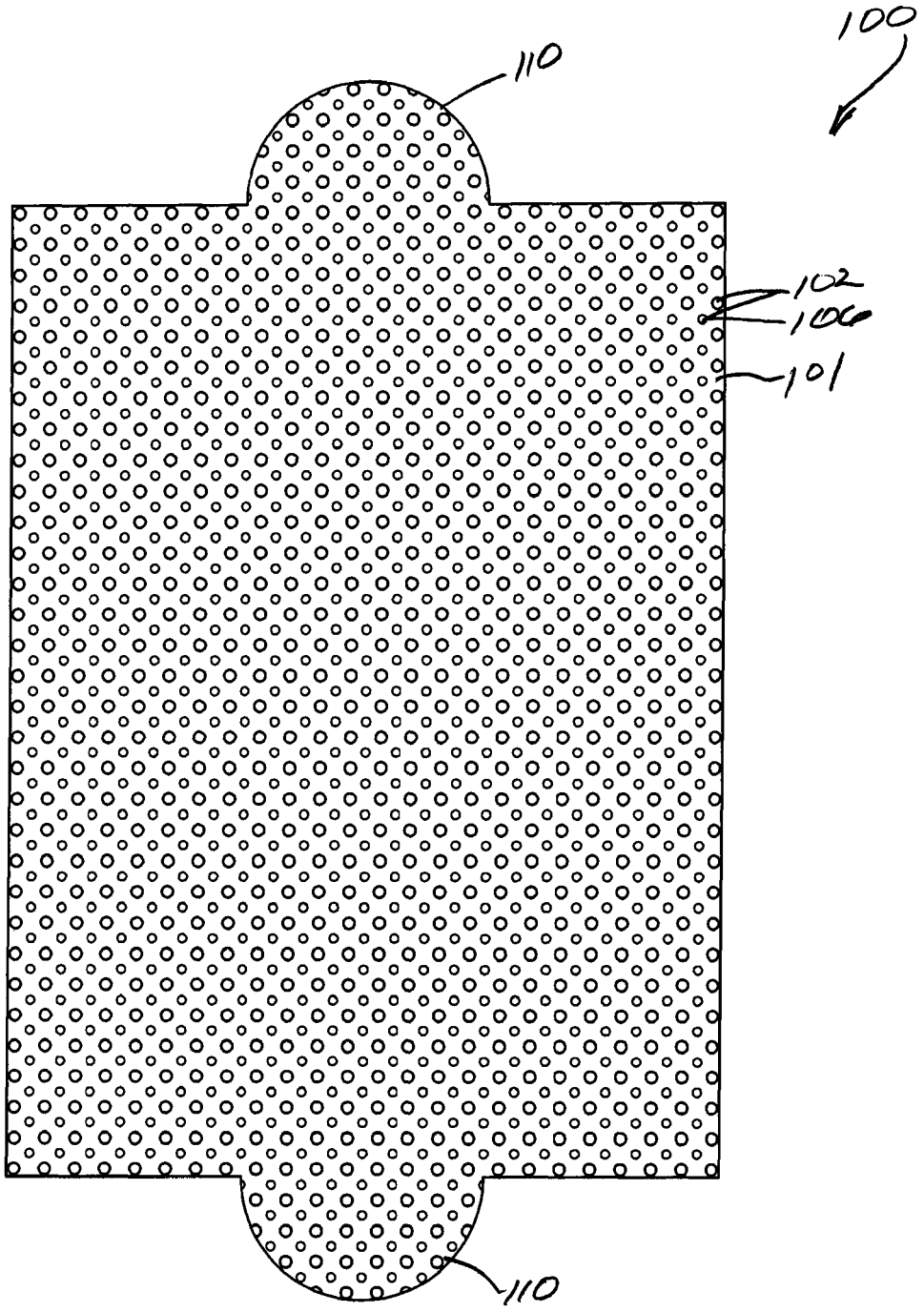
FIG. 32 is a plan view of another embodiment of a rectangular embossed sheet with an embossing pattern on both sides of the sheet material and two handle tabs.
Figure 36:
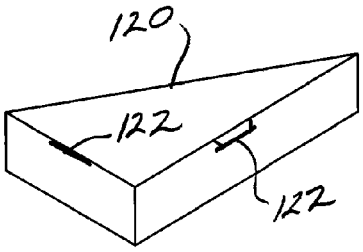
FIG. 36 is a perspective view of the triangular container formed from the embossed sheet of FIG. 35.

FIGS. 31-32 illustrate another embodiment of an embossed sheet 100 wherein the sheet is rectangular in shape. Such an embodiment may be particularly adapted for placement on a cookie sheet or similar pan and used for baking or reheating foods. As in the previous embodiments, the projections 102 provide an intermittent support surface and an airspace below the food which may allow the food to heat or bake more quickly and uniformly. Additionally, it should be appreciated that the use of an embossed sheet 100 when baking or heating foods in a pan will minimize or eliminate cleanup. Additionally, depending on the food product being baked or heated, the food product may be lifted out of the pan all at once by grasping the edges of the sheet or the handle tabs 110.

Based on the foregoing, it should be appreciated that the embossed sheet 100 may incorporate any combination of any of the above-identified elements or features, whether or not each and every different combination of features is illustrated in the drawing figures.

FIGS. 33-36 illustrate another embodiment of an embossed sheet 100 wherein the sheet is cut in a desired pattern for folding into a food package 120. The embossed sheet 100 is die cut and scored with score lines 108 to fold into a triangular food package 120 (FIGS. 34, 36), for single slice pizza, for example. As in the previous embodiments, the projections 102 provide an airspace below the food which minimizes the chance of the food becoming soggy from sitting in condensation or other drippings that may collect inside the package 114. The embossed sheet may have embossing on one side (FIG. 33) or both sides (FIG. 35) as previously described. In the embodiments illustrated in FIGS. 33 and 35, pie-shaped cutouts 112 create flaps 114 which fold to create the triangular package 120. Tabs 118 may be provided to insert into aligning slots 122 to secure the sides together. Other configurations and arrangements of score lines, cutouts, flaps, tabs and slots may be used to produce other package shapes.

Figure 38A:
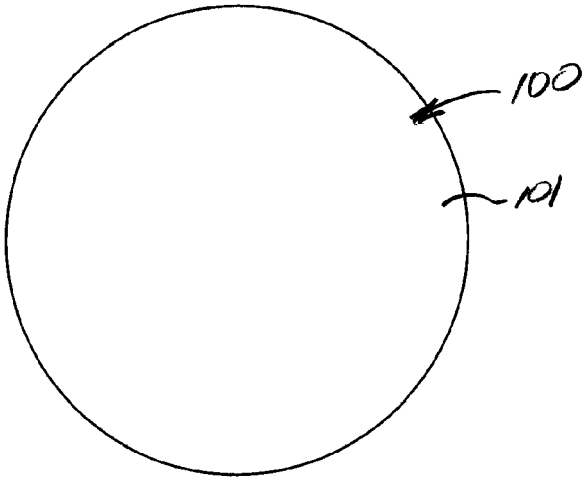
FIG. 38A-38D illustrates folding an embossed sheet (embossing pattern not shown) for forming the pizza-slice-shaped package of FIG. 37.
Figure 38B:
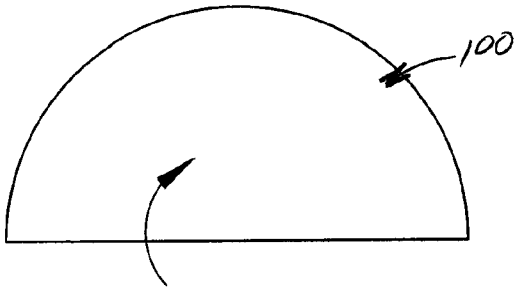
Figure 38C:
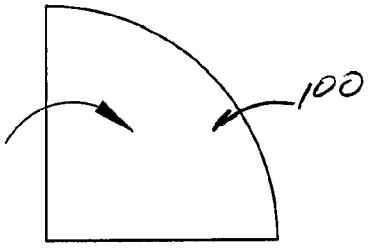
Figure 38D:
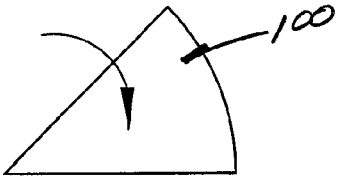
Figure 37:
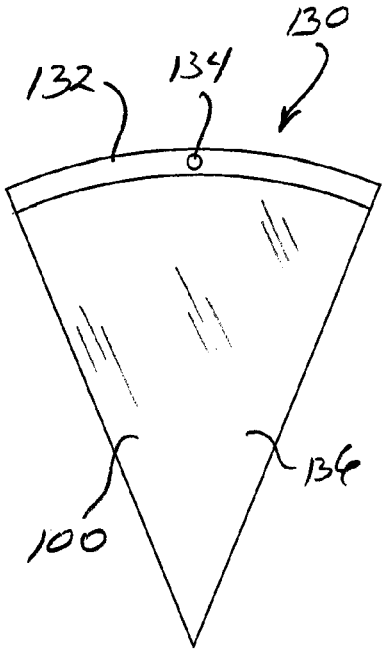
FIG. 37 shows a pizza-slice-shaped retail package containing a folded embossed sheet.

FIG. 37 illustrates a pizza-slice-shaped retail package 130 containing one or more embossed sheets 100 folded into the shape of a pizza-slice. The package 130 may include a paperboard backing 132 with an aperture 134 for hanging the package on a hook in a retail store. Plastic wrap 136 may be used to secure the folded sheets 100 to the backing 132. FIGS. 38A-38D illustrate the steps in folding a circular embossed sheet (embossing pattern not shown) for forming the pizza-slice-shaped package of FIG. 35. As illustrated in FIG. 38B, the circular embossed sheet 100 of FIG. 38A is folded in half. The half-circle sheet of FIG. 38B is folded in half again to as illustrated in FIG. 38C. The quarter-circle sheet of FIG. 38C is folded in half again to as illustrated in FIG. 38D. The eighth-circle sheet of FIG. 38D now in the shape of a pizza-slice can be packaged alone or with a plurality of similarly folded sheets 100 to create the pizza-sliced shaped package 130 of FIG. 37.

In one method of use of the embossed sheet 100, the embossed sheet 100 is placed into a pizza box. The cooked pizza is placed onto the embossed sheet within the pizza box. The pizza is then cut while on top of the embossed sheet within the box. The box is then closed for delivery or takeout.

In another method of use of the embossed sheet 100, the embossed sheet 100 is placed onto a table surface or tray. The cooked pizza is placed onto the embossed sheet. The pizza is then cut on the embossed sheet. The embossed sheet with the cut pizza on top is lifted from the table surface and placed into the pizza box for delivery or takeout, or, alternatively, the embossed sheet 100 with the cooked pizza on top is slid from the tray into the pizza box for delivery or takeout, or, alternatively, the pizza is served from the tray with the embossed sheet 100 under the pizza.

In another method of use of the embossed sheet 100, the embossed sheet 100 having the necessary properties or barrier coating such that it is bakeable, is placed into a pizza pan, the uncooked pizza crust dough is placed on top of the embossed sheet. The desired toppings are added on top of the pizza crust dough. The pizza pan containing the prepared uncooked pizza on top of the embossed sheet 100 is placed into the oven and cooked. The pizza pan with the cooked pizza is removed from the oven. The cooked pizza along with the embossed sheet 100 is removed from the pan and placed on a table surface or tray. The pizza is then cut on the embossed sheet, the embossed sheet with the cut pizza on top is lifted from the table surface and placed into a pizza box for delivery or takeout, or alternatively the embossed sheet 100 with the pizza on top is slid from the tray into the pizza box for delivery or takeout, or, alternatively, the pizza is served from the tray with the embossed sheet 100 under the pizza.

In another method of use of the embossed sheet 100, the embossed sheet 100 having the necessary properties or barrier coating such that it is bakeable, is placed into a pizza pan, the pizza crust dough is placed on top of the embossed sheet. The desired toppings are added on top of the pizza crust dough. The pizza pan containing the prepared uncooked pizza on top of the embossed sheet 100 is placed into the oven and cooked. The pizza pan with the cooked pizza is removed from the oven. The cooked pizza along with the embossed sheet 100 is removed from the pan and placed into a pizza box. The pizza is then cut on the embossed sheet within the pizza box. The box is then closed for delivery or takeout.

In another method of use of the embossed sheet 100, the embossed sheet 100 having the necessary properties or barrier coating such that it is bakeable is provided. The pizza crust dough is placed on top of the embossed sheet 100. The desired toppings are added on top of the pizza crust dough. The prepared uncooked pizza together with the embossed sheet is wrapped with plastic wrap or other suitable wrap and provided to a consumer for take-and-bake. The consumer removes the wrapping and places the prepared uncooked pizza together with the embossed sheet 100 into an oven for cooking. The cooked pizza together with the embossed sheet 100 is removed from the oven and placed on a table surface or tray. The pizza is then cut on the embossed sheet 100 and served.

In another method of use of the embossed sheet 100, the embossed sheet 100 having the necessary properties or barrier coating such that it is bakeable is provided. The pizza crust dough is placed on top of the embossed sheet 100. The desired toppings are added on top of the pizza crust dough. The prepared uncooked pizza together with the embossed sheet 100 is wrapped with plastic wrap or other suitable wrap and frozen. A consumer removes the wrapping and places the prepared uncooked pizza on the embossed sheet 100 into an oven for cooking. The cooked pizza together with the embossed sheet 100 is removed from the oven and placed on a table surface or tray. The pizza is then cut on the embossed sheet 100 and served.

In another method of use of the embossed sheet 100, the embossed sheet 100 having the necessary properties or barrier coating such that it is bakeable is provided. The pizza crust dough is placed on top of the embossed sheet 100. The desired toppings are added on top of the pizza crust dough. The prepared uncooked pizza together with the embossed sheet 100 is wrapped with plastic wrap or other suitable wrap and frozen. A consumer removes the wrapping and removes the frozen uncooked pizza from the embossed sheet 100 prior to placing the frozen pizza in the oven for cooking. The cooked pizza is removed from the oven and placed back on the embossed sheet 100. The cooked pizza on the embossed sheet 100 is then cut on the embossed sheet 100 and served.

Figure 40:
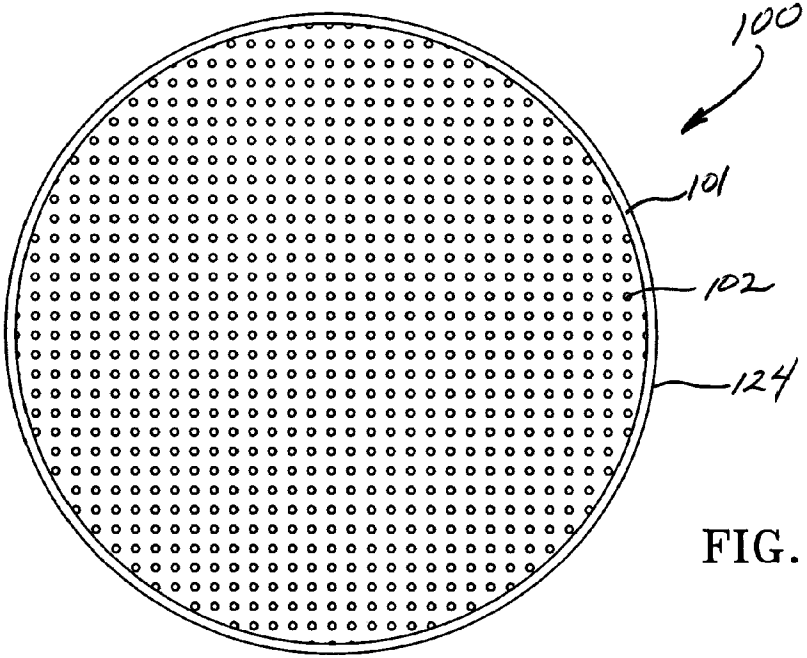
FIG. 40 is a plan view of an embodiment of a circular embossed sheet having an embossing pattern on one side formed from the platen press of FIG. 39.
Figure 39:
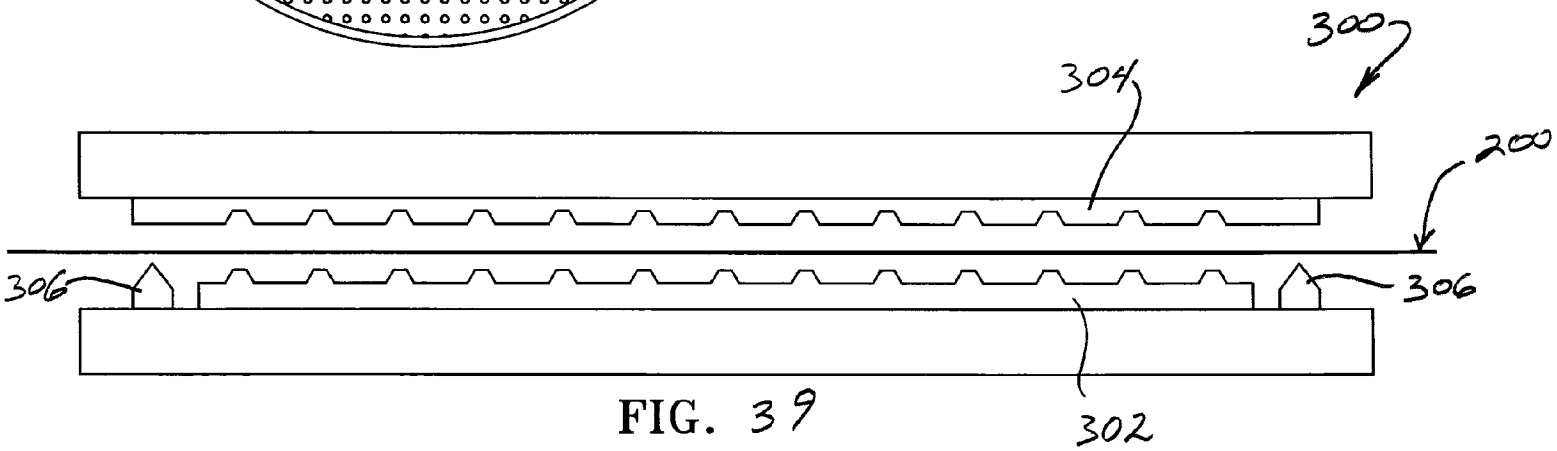
FIG. 39 is a schematic illustration of a single-pass platen press with an embossing pattern for embossing one side of the sheet material.
Figure 42:
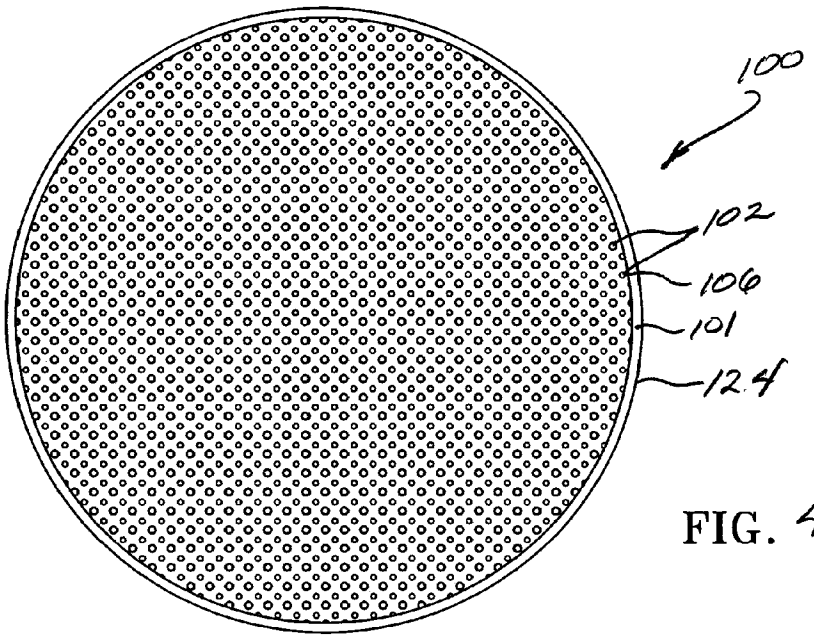
FIG. 42 is a plan view of an embodiment of a circular embossed sheet having an embossing pattern on both sides formed from the platen press of FIG. 41.
Figure 41:
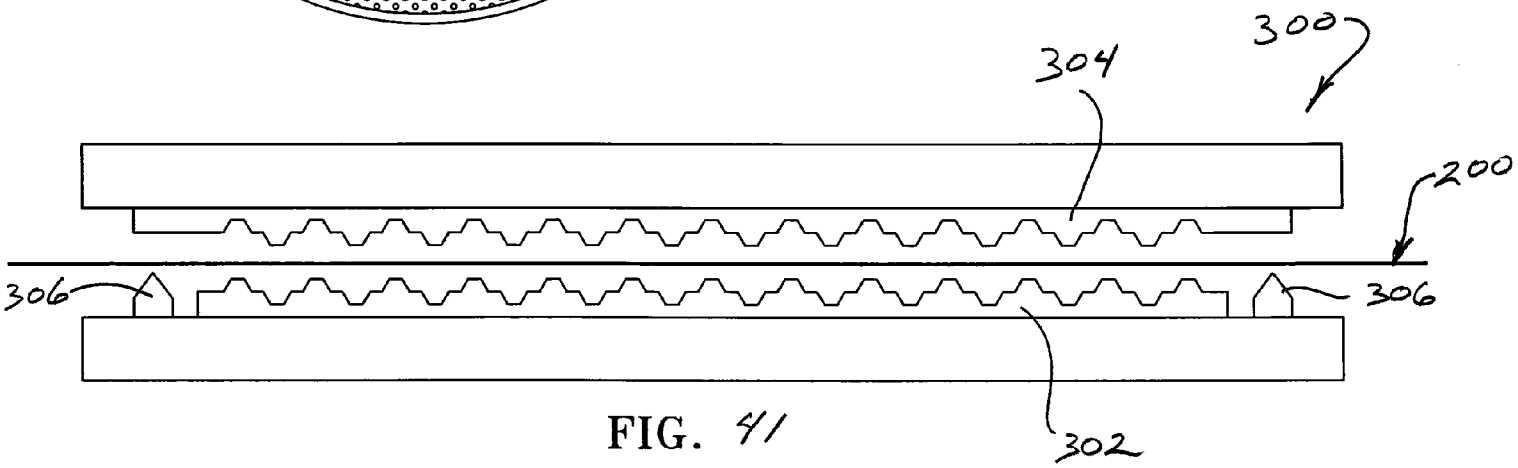
FIG. 41 is a schematic illustration of a single-pass platen press with an embossing pattern on each side of the sheet material.

FIGS. 39 and 41 schematically illustrate a one-pass platen press 300 whereby a stock 200 of sheet material 101 is embossed and die-cut. The schematic illustration of the platen press 300 of FIG. 39 is intended to represent a one-pass process that produces an embossed sheet 100 with one side of the sheet material 101 embossed with projections 102 as shown in FIG. 40. The schematic illustration of the platen press 300 of FIG. 41 is intended to represent a one-pass process that produces an embossed sheet 100 with both sides of the sheet material 101 are embossed with projections 102 as shown in FIG. 42. As illustrated, the platen press 300 includes a male die portion 302 having a raised or positive embossing pattern and a female die portion 304 have a complimentary recessed or negative embossing pattern. In operation, the stock 200 of sheet material 101 is placed between the male and female die portions 302, 304, the die portions are then brought together with the requisite force and then released thereby creating the complimentary embossing pattern in the sheet material 101. As the die portions are brought together, the cut rules 306 die-cut the stock 200 to the desired configuration of the embossed sheet 100. The embossed and die-cut sheet then passes to a blanking unit (not shown) which blanks the finished embossed sheet 100 from the remainder of the stock 200 and automatically stacks the finished embossed sheet 100 for packaging. Those of skill in the art will appreciate that with a one pass system, wherein the press includes both the embossing pattern and the cut rules 306, a space of approximately 0.25 inches between the edge of the cut rules 306 and the embossing pattern is typically necessary. Thus, the embossed sheets 100 illustrated in FIGS. 40 and 42 show a space between the embossing pattern and the outer peripheral edge 124 of the embossed sheet 100. If a two-pass system is used (discussed below), then no gap or space is necessary. Thus, as shown in most of the other drawing figures, the embossing pattern can extend to the outer peripheral edge 124 of the embossed sheet 100.

Rather than a one-pass process, a two-step process may be used to produce the embossed sheets 100. The two-pass process is similar to the one-pass process except that two passes through the press are required instead of one. In the first pass, the stock 200 of sheet material 101 is embossed. In the second pass, the embossed stock is fed through the press again to die-cut the sheet. The embossed and die-cut sheet then passes to a blanking unit (not shown) which blanks the finished embossed sheet 100 from the remainder of the stock 200 and automatically stacks the finished embossed sheet 100 for packaging. One-pass and two-pass processes are well known in the art and therefore further description of the equipment and processes are not warranted.

Figure 35:
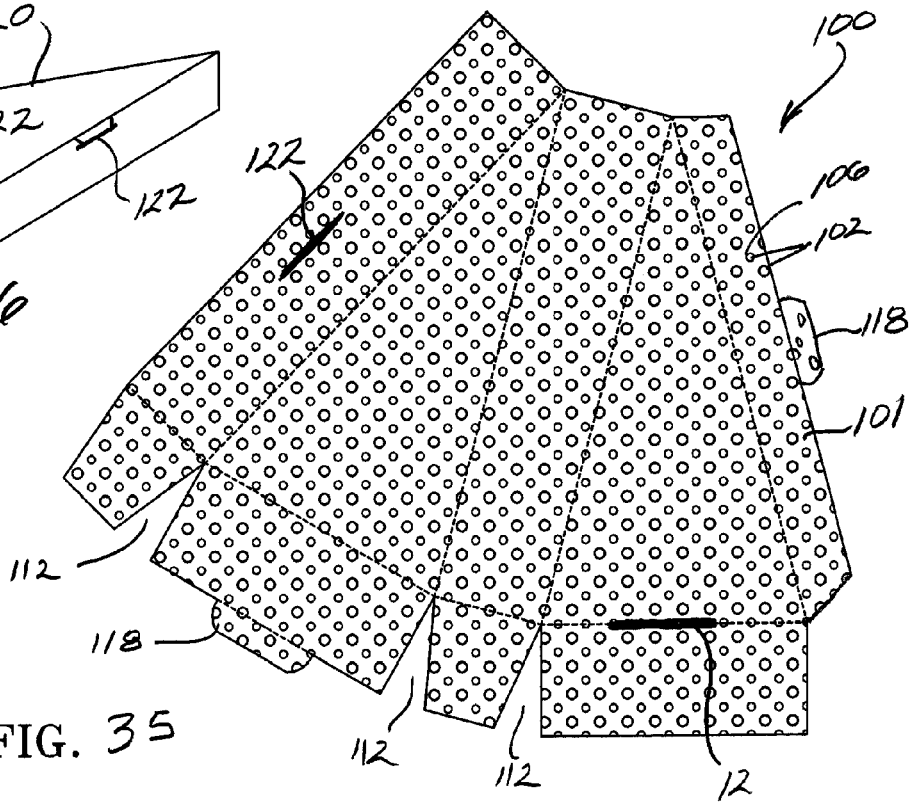
FIG. 35 is a plan view of another embodiment of an embossed sheet cut to form a triangular container, wherein the embossed sheet includes an embossing pattern on each side of the sheet material, cutouts, tabs and slots for folding and forming the triangular container.
Figure 34:
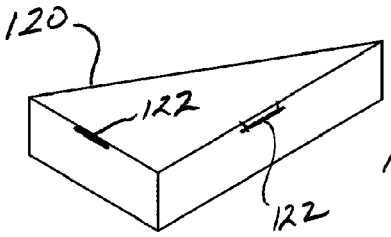
FIG. 34 is a perspective view of the triangular container formed from the embossed sheet of FIG. 33.
Figure 33:
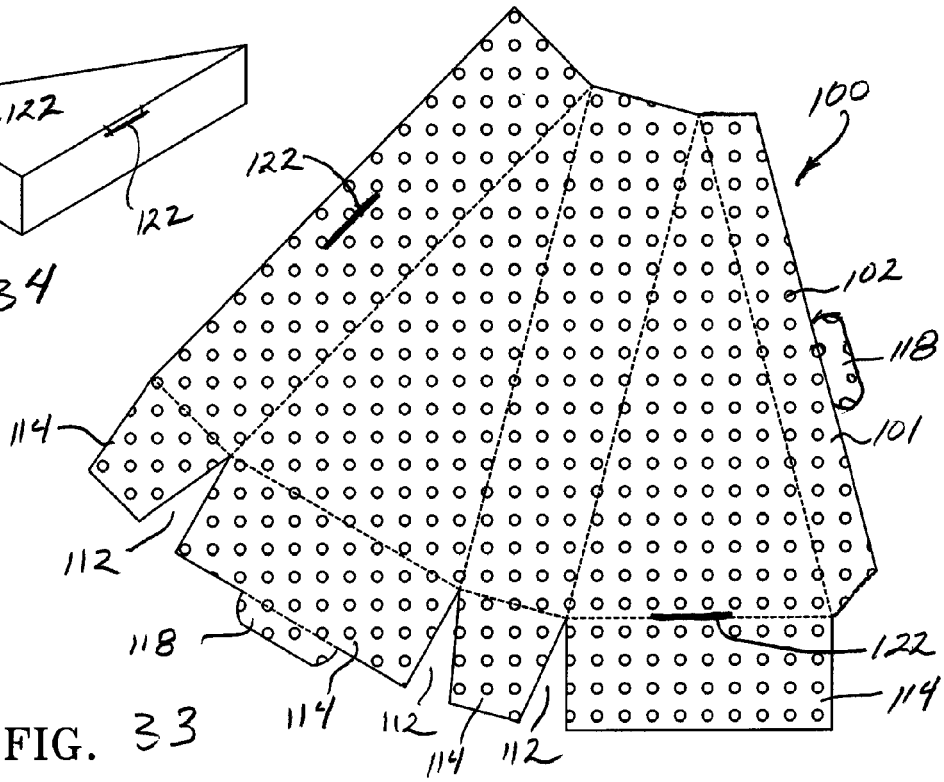
FIG. 33 is a plan view of another embodiment of an embossed sheet cut to form a triangular container, wherein the embossed sheet includes an embossing pattern on one side of the sheet material, cutouts, tabs and slots for folding and forming the triangular container.

In yet another alternative process, a one-pass, multi-stage process may be used to prepare the embossed sheets 100. For example, a machine such as an MK21060SER manufactured by Masterwork USA LLC, Flanders, N.J., can be configured to prepare an embossed sheet 100 through sequential multi-stage steps in one pass through the machine. As illustrated in FIG. 43, the multi-stage machine 400 comprises a feeder 402, a feed table 404, an embossing and die-cutting unit 406, a stripping unit 408 (if internal cuts are desired), a blanking unit 410, and a waste collection unit 412. In operation, a stack of stock 200 of sheet material 101 is loaded into the feeder 402. The feeder discharges singular sheets of the stock 200 onto the feeder table 404 which conveys the stock sheet 200 to the embossing and die-cutting unit 406. The embossing and die-cutting unit 406 embosses the stock sheet 200 and makes any internal cuts (such as the cutouts 111 of the handle tabs 110 (FIG. 18)) and the cuts which define the size and shape of the final embossed sheet 100, the score lines 108 (FIGS. 13, 15, 23-28), the vent cuts 116 (FIGS. 29-30) and/or slots 122 (FIGS. 33, 35). After the embossing/die-cutting stage 406, the embossed and die-cut sheet stock 202 passes through the stripping stage 408 which strips or removes any internal cutouts 409 from the sheet 202. It should be appreciated that if no internal cuts are made in the sheet, the stripping stage 408 may be eliminated. The sheet 204 then passes to the blanking unit 410 which blanks the finished embossed sheet 100 from the stripped sheet 204 and automatically stacks the finished embossed sheets 100 for packaging. The remaining sheet 206 is collected as waste at the waste collection stage 412.

In another configuration of the multistage machine 400, as illustrated in FIG. 44, the multi-stage machine 400 comprises the same feeder 402 and feed table 404, but in this configuration, an embossing unit 414 separate from a die-cutting unit 416 is provided. Additionally, a stripping/blanking unit 418 is provided. In operation, a stack of stock 200 of sheet material 101 is loaded into the feeder 402. The feeder discharges singular sheets of the stock 200 onto the feeder table 404 which conveys the stock sheet 200 to the embossing unit 414. The embossing unit 414 embosses the stock sheet 200. After the embossing stage 414, the embossed stock sheet 210 passes to the die-cutting unit 416 which makes any internal cuts such as the cutouts 111 of the handle tabs 110 (such as cutouts 111 of the handle tabs 110 (FIG. 18)) and the cuts which define the size and shape of the final embossed sheet 100, the score lines 108 (FIGS. 13, 15, 23-28), the vent cuts 116 (FIGS. 29-30) and/or slots 122 (FIGS. 33, 35). The embossed and die-cut sheet 212 passes to the stripping and blanking unit 418 which strips (if applicable) and blanks the finished embossed sheet 100 from the remainder of the previously embossed and die-cut sheet 212. From the stripping and blanking unit, the finished embossed sheets 100 are automatically stacked for packaging.

It should be appreciated that the embossing/die cutting unit 406 may comprise the one-pass platen press 300 as previously described in connection with FIGS. 39 and 41. Similarly it should be appreciated that embossing unit 414 and the die-cutting unit 416 of FIG. 44 may be replaced with a single one-pass platen press 300 as previously described in connection with FIGS. 39 and 41.

Figure 46:
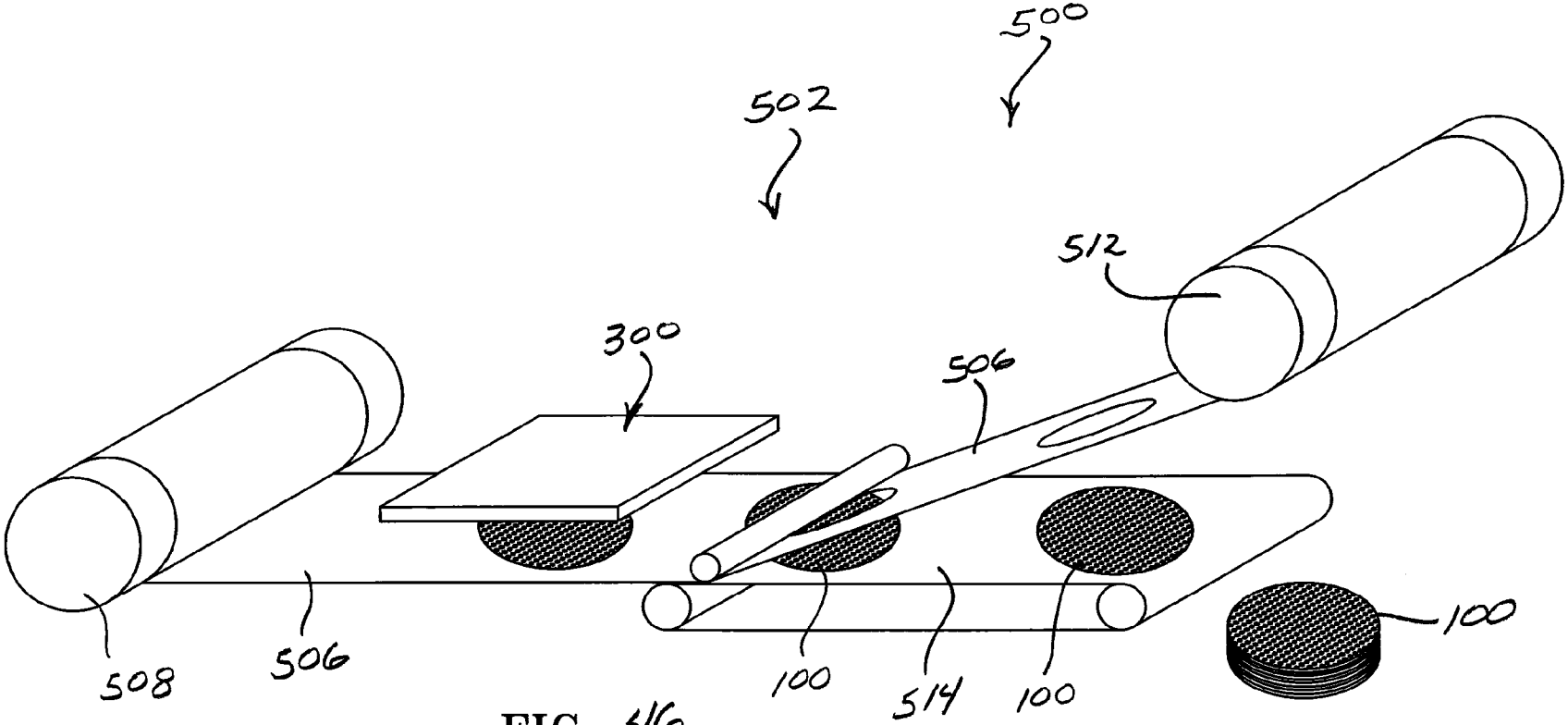
FIG. 46 is a schematic illustration of an embodiment of a stop-and-go roll-to-roll process for forming an embossed sheet.

In still another alternative method of preparing embossed sheets 100, rather than using a platen press process, a roll-to-roll process 500 may be used. The roll-to-roll process may be a continuous roll-to-roll process 502 (FIG. 45) or a stop-and-go roll-to-roll process 504 (FIG. 46). In the continuous roll-to-roll process 502, a long web 506 of sheet material 101 is rolled onto a first roll 508. The web 506 is fed through a rotary embossing die 510 and a cutting die 511. As the rotary embossing die 510 rotates over the web, the sheet material 101 is embossed with the embossing pattern. As the rotary cutting die rotates over the web, the sheet material 101 is die-cut. The remaining web 506 is rolled onto the second roll 512 while the finished embossed sheet 100 drops to a conveyor 514 which conveys the finished embossed sheets 100 to be stacked and packaged. A single roller that embosses and die-cuts at the same time may also be used.

In a stop-and-go roll-to-roll process 504, a long web 506 of sheet material 101 is rolled onto a first roll 508. The web 506 preferably passes under a one-pass platen press 300 as previously described which embosses, die-cuts and blanks the finished embossed sheet 100. It should be appreciated that in this process, the web 506 will momentarily stop to permit the platen press 300 to press down on the web to emboss and die-cut the finished embossed sheet 100. When the platen press 300 is released, the web 506 will resume rolling onto the second roll 512 until the width of web 506 corresponding to the width of the platen press 300 passes, at which point the web will again stop, the platen press will be actuated to emboss and die-cut another finished embossed sheet 100 and so on. As in the previous embodiment, the remaining web 506 is rolled onto the second roll 512 while the finished embossed sheet 100 drops to a conveyor 514 which conveys the finished embossed sheets 100 to be stacked and packaged.

The foregoing description is presented to enable one of ordinary skill in the art to make and use the invention and is provided in the context of a patent application and its requirements. Various modifications to the preferred embodiments of the apparatus and the general principles and features of the system and methods described herein will be readily apparent to those of skill in the art. Thus, the present invention is not to be limited to the embodiments of the apparatus, system and methods described above and illustrated in the drawing figures, but is to be accorded the widest scope consistent with the spirit and scope of the appended claims.

The invention claimed is:

1. In combination, an insert and a food container made from recycled material, the insert comprising:

a bakable paper-based sheet material receivable by the food container, the sheet material having an upper surface and a lower surface, a plurality of upper projections extending generally upwardly from the upper surface and a plurality of lower projections extending generally downwardly from the lower surface, each of the plurality of upper projections being circular and extending approximately 0.01 inches to approximately 0.04 inches above the upper surface of the sheet material and having a planar upper projection surface, and wherein the upper projection surfaces form an intermittent upper support surface and each of the plurality of lower projections being circular and extending approximately 0.01 inches to approximately 0.04 inches below the lower surface of the sheet material and having a planar lower projection surface, and wherein the lower projection surfaces form an intermittent lower support surface and, wherein an upper side of each lower projection forms a reservoir adapted to receive a liquid; and at least one handle tab extending outwardly from an edge of the paper based sheet material and adapted to permit a user of the insert to reposition the insert without contacting the food product;

wherein the intermittent upper support surface is adapted to support a food product placed thereon while also providing an open space under the food product, and wherein the intermittent lower support surface is adapted to be supported by an inner interior surface of the food container and to thus provide an open space between the sheet material lower surface and the inner interior surface of the food container.

2. The combination of claim 1, wherein each upper projection defines an upper projection space and each lower projection defines a lower projection space, the upper projection spaces being adapted to receive a second plurality of upper projections extending generally upwardly from an upper surface of a second sheet material and the lower projection spaces being adapted to receive a plurality of lower projections extending generally downwardly from a lower surface of the second sheet material when the sheet materials are stacked.

3. The combination of claim 1, wherein the handle tab is formed from an integral extension of the bakable paper-based sheet material and includes the plurality of upper projections and the plurality of lower projections, and is configured to promote an event including an event selected from the group of a sporting event, a holiday, or an occasion.

4. The combination of claim 3, wherein the upper projection surfaces and the lower projection surfaces are substantially semi-spherical.

5. The combination of claim 3, wherein the upper projection surfaces and the lower projection surfaces are substantially frustoconical.

6. The combination of claim 1, wherein the upper projections and upper surface of the sheet material define an interconnected matrix of open spaces in communication with the reservoirs.

7. The combination of claim 6, wherein the interconnected matrix of open spaces is adapted to convey the liquid to the reservoirs.

8. The combination of claim 7, wherein the sheet material, the upper projections and the lower projections are formed continuously from a single sheet of substantially liquid-impermeable material.

9. The combination of claim 8, wherein the sheet material is configured to be received by a bakeable pan.

10. The combination of claim 7, wherein the upper projections and the lower projections are embossed in the sheet material.

11. The combination of claim 10, wherein the at least one handle tab is formed from an integral extension of the bakable paper-based sheet material and includes the plurality of upper projections and the plurality of lower projections, and is configured to promote an event including an event selected from the group of a sporting event, a holiday, or an occasion.

12. The combination of claim 8, wherein the handle tab is formed from an integral extension of the bakable paper-based sheet material and includes the plurality of upper projections and the plurality of lower projections, and is configured to promote an event including an event selected from the group of a sporting event, holiday, or occasion.

13. A food container, comprising:

a sheet of bakable paper-based material convertible into a closable food container, the sheet material having an upper surface and a lower surface and wherein the closable food container defines an interior space adapted to receive a food product;

the sheet material having a plurality of upper projections extending generally upwardly from the upper surface and a plurality of lower projections extending generally downwardly from the lower surface, each of the plurality of upper projections being circular, having a diameter of approximately 0.1875 inches, extending approximately 0.01 inches to approximately 0.04 inches above the upper surface and having an upper projection surface, and wherein the upper projection surfaces form an intermittent upper support surface, and each of the plurality of lower projections being circular, having a diameter of approximately 0.1875 inches, extending approximately 0.01 inches to approximately 0.04 inches below the lower surface and having a lower projection surface and wherein the lower projection surfaces form an intermittent lower support surface;

wherein an upper side of each of the plurality of lower projections forms a reservoir adapted to receive a liquid;

wherein at least a portion of the intermittent upper support surface is adapted to support the food product placed thereon while also providing an open space under the food product; and wherein the upper projection surfaces and the lower projection surfaces are substantially frustoconical.

14. A food container, comprising:

a sheet of bakable paper-based material convertible into a closable food container, the sheet material having an upper surface and a lower surface and wherein the closable food container defines an interior space adapted to receive a food product;

the sheet material having a plurality of upper projections extending generally upwardly from the upper surface and a plurality of lower projections extending generally downwardly from the lower surface, each of the plurality of upper projections being circular, having a diameter of approximately 0.1875 inches, extending approximately 0.01 inches to approximately 0.04 inches above the upper surface and having an upper projection surface, and wherein the upper projection surfaces form an intermittent upper support surface, and each of the plurality of lower projections being circular, having a diameter of approximately 0.1875 inches, extending approximately 0.01 inches to approximately 0.04 inches below the lower surface and having a lower projection surface and wherein the lower projection surfaces form an intermittent lower support surface;

wherein an upper side of each of the plurality of lower projections forms a reservoir adapted to receive a liquid;

wherein at least a portion of the intermittent upper support surface is adapted to support the food product placed thereon while also providing an open space under the food product;

wherein the upper projections and the upper surface of the sheet material define an interconnected matrix of open spaces in communication with the reservoirs, with the interconnected matrix of open spaces adapted to convey liquid to the reservoirs; and wherein the upper projection surface of the plurality of upper projections is planar and the lower projection surface of the plurality of lower projections is planar.

15. The food container of claim 14, wherein the upper projections and the lower projections are embossed in the sheet material.

16. The food container of claim 15, further comprising:

at least one handle tab coupled to the sheet material adapted to permit a user of the insert to reposition the insert without contacting portions of the sheet material in contact with the food product.

* * * * *